United States Patent [19]

Kitazume et al.

[11] Patent Number: 5,026,041

[45] Date of Patent: Jun. 25, 1991

[54] AUTOMATIC SHEET FEEDING APPARATUS

[75] Inventors: Koichi Kitazume; Kimikazu Arai, both of Tokyo, Japan

[73] Assignee: Daiwa Seiko, Inc., Tokyo, Japan

[21] Appl. No.: 444,446

[22] Filed: Dec. 1, 1989

[30] Foreign Application Priority Data

Dec. 5, 1988 [JP] Japan ..... 63-159044
Dec. 5, 1988 [JP] Japan ..... 63-159045
Dec. 5, 1988 [JP] Japan ..... 63-309098
Dec. 5, 1988 [JP] Japan ..... 63-309099

[51] Int. Cl.[5] ..... B65H 3/06
[52] U.S. Cl. ..... 271/118; 271/127
[58] Field of Search ..... 271/127, 117, 118

[56] References Cited

U.S. PATENT DOCUMENTS 4,714,243 12/1987 Staniszewski ..... 271/127 X
4,838,535 6/1989 Yokoi ..... 271/127 X

*Primary Examiner*—Richard A. Schacher
*Attorney, Agent, or Firm*—Kalish & Gilster

[57] ABSTRACT

The present invention relates to an automatic cut sheet feeding apparatus for feeding a stack of sheet one by one into a printer, and particularly to an automatic sheet feeding apparatus used for a printer for making an impact print onto a sheet positioned on a platen by a wire dot, shuttle, or other methods. In this invention, the positive rotation of the sheet feed motor is transmitted to a sheet feed roller through a rotation transmission mechanism to rotate the sheet feed roller, thereby sending one of sheet on a pressure plate to a printer unit at a time. Then, when the sheet is grasped by the sheet feed rollers of the printer unit, the sheet feed motor reversely rotates to a certain extent and its rotation is transmitted to the rack and pinion mechanism through the rotation transmitting mechanism, thereby moving the pressure plate backward against the pushing mechanism to separate the stacked sheets from the sheet feed roller, and at the same time, the reverse transmission of the pressure plate is retained by the holding mechanism.

Therefore, in the present invention, to feed a sheet in the print unit the sheet feed unit loses its working effect on the sheet, reducing a sheet feeding load in sending the sheet in the print unit. And the changes in the sheet volume accommodated in the sheet feed stacker can keep a fixed gap which is formed between the stacked sheets and the sheet feed roller due to the backward movement of the pressure plate.

5 Claims, 18 Drawing Sheets

AUTOMATIC SHEET FEEDING APPARATUS

BACKGROUND OF THE INVENTION

1. Field of the Invention

The present invention relates to an automatic cut sheet feeding apparatus for feeding stacked sheets one by one into a printer, and particularly to an automatic sheet feeding apparatus used for a printer for an impact printing onto a sheet positioned on a platen by wire dots, shuttle, or other methods.

2. Description of the Prior Art

A printer such as disclosed in U.S. Pat. No. 4,687,362 for example has a sheet fed from a unit 15 is pinched between a platen 10 and pinch rollers 17 of a printer unit 19, fed to be rolled around the platen 10, and the sheet surface printed by impact by means of a wire dot type printer head.

In the state that the sheet is fed along the platen 10, the back of the sheet is pressed against a separating roller 7 by means of tow supply stocks via a V-shaped support 21.

It is now demanded to provide a high quality printing which provides letters with clear edges and easily readable. To provide high quality letters, a platen may be made harder but materials with high hardness (metal, hard rubber, etc.) have low coefficient of friction, inferior sheet feeding capacity, and lowered coefficient of friction due to hardening of its surface and planishing caused by impact with the wire dots, thus induces disadvantages including lowered sheet feeding with the platen. Therefore, U. S. Pat. No. 4,687,362 has enhanced the hardness of the platen to provide better printing quality, inducing a drawback of resistance at the back side of sheets at the stacker section.

Specifically, in the state that the leading edge of a cut sheet which is fed to the printer from the automatic sheet feeding apparatus is grasped by the first sheet feed roller, the end part of that sheet remains being pressed by the sheet feeding roller at the stacker section. Therefore, the feeding operation by the sheet feeding roller at the printer section rotates the sheet feeding roller in the stacker section accordingly, but the friction resistance of the sheet feeding roller bearing and that of sheets due to pressure toward the feeding roller apply loads onto the sheet feeding roller in the printer side, inducing a defect in sheet feeding.

Therefore, in the prior apparatus, the sheet feeding stacker was provided with an electromagnetic plunger which moved the pressure plate backward. Magnetizing this electromagnetic plunger by applying an electric current thereto moved the pressure plate backward to separate the sheet from the sheet feeding roller, thereby removing the sheet feeding load from the sheet feeding roller on the paper feeding unit.

The above existing automatic sheet feeding apparatus supplies a sheet from the sheet feeding stacker to the printer unit by means of the sheet feeding roller, holds the leading edge of the sheet by the sheet feeding roller, moves back the pressure plate to separate the sheet from the sheet feeding roller, and removes a sheet feeding load on the sheet feeding unit with respect to the sheet feeding roller, thereby stabilizing the sheet feeding in the printer.

But, the method moving the pressure plate back by means of the electromagnetic plunger needs to-hold the electromagnetic plunger in the condition that electricity applied until the sheet fed from the sheet feeding stacker is completely sent to the printer together with the printing operation of the printer. Therefore, there were drawbacks that the electricity supplying time to the electromagnetic plunger became long and heated the electromagnetic plunger, a heat resistant electromagnetic plunger was required, mechanism for moving the pressure plate backward became expensive and large, and the sheet feeding unit must be made heavy.

Conventionally, this type of automatic sheet feeding apparatus includes a type that detects the stacked volume of sheets accommodated in the paper feeding stacker by using a sensor, controls the electrical actuator by the detected signal to retract the pressure plate according to the stacked sheet volume, and separates the stacked sheets from the sheet feeding roller, or a type that regardless of the sheet volume accommodated in the sheet feeding stacker, the pressure plate is retracted to a prescribed position by the electromagnetic plunger or the like.

The above former type needs a sensor and an electric powered actuator for operating the pressure plate, decision of the distance the pressure plate is moved backward according to the sheet volume, and a calculation control circuit to control the electric actuator, making the retracting drive mechanism expensive and the electric actuator must be provided additionally, and the sheet feeding unit becomes heavy.

In the above latter type, regardless of the sheet volume accommodated in the sheet supplying stacker, the pressure plate is retracted to the prescribed position, so that when the sheet volume is not much, the top surface of the stacked sheets on the pressure plate and the sheet feeding plate are far separated, and the pressure plate moves backward more than required inducing a loss of time, making the sheets stacked on the sheet supplying stacker are not kept in order resulting from the forward and backward movements of the pressure plate, causing skew, disordered printing position, and greater gap from the sheet feeding roller. Thus, sheets are buckled or not fed smoothly.

In such automatic sheet supply apparatuses, the pressure plate is moved backward by means of an electric plunger so that the gap between the sheet feeding roller and the stacked sheet is kept at a certain level. And sheets exceeding the optimum volume are accommodated in the sheet feeding stacker and when the length obtained by adding the retracted distance of the pressure plate to the stacked thickness of sheets exceeds the maximum retraction of the pressure plate, the electric plunger moves the pressure plate backward and the pressure plate reaches the maximum retraction prior to moving back the prescribed distance. Therefore, the electric plunger is stopped on its way and held with the electricity applied, resulting in over-heating the electric plunger and damaging.

It has heretofore been known is a flat type printer which is for example disclosed in Japanese Utility Model Application Laid-open No. 63-66241.

This type of printer holds the platen disposed to oppose the print head in a fixed state and makes the contact surface of the platen flat against the print head, and a pair of feeding rollers are vertically disposed at the front and back of the platen. These feeding rollers carry the sheet each fed from the automatic sheet feeding apparatus onto the platen in a flat state, and the sheet is printed on the flat surface of the platen.

In the above flat type printer, the platen has a flat area which contacts the print head, making the periphery of letters clear and does not allow the sheet rolled around the platen as in using the roll type platen but has disadvantages that the pair of sheet feeding rollers disposed at the front and back of the platen are made of synthetic rubber or other elastic materials. But since the top and bottom rollers contact very lightly, their sheet feeding force is small, so that when any resistance is applied to the sheet, the sheet slips and is not fed stable, resulting in ununiform line spaces between printed lines on the sheet.

To remedy the above slip trouble, increasing the contact pressure between the top and bottom rollers is considered, but it may result in increasing the roller driving power and requiring a motor with power greater than for driving a tangential contact type roller, and also materials which are not easily deformed are required for the roller supporting shaft and its support members. Thus, other problems are induced including the increase of weight, size, and costs.

And, the flat type printer, as described above, each pair of sheet feeding rollers disposed at the front and back of the platen are made of synthetic rubber or other elastic materials and the top and bottom rollers are contacted lightly, so that the sheet feeding force is small. Therefore, when the sheet feeding roller in the printer starts feeding the sheet carried from the automatic paper feeding apparatus with the operation of the printer, if the bottom end of the sheet is pressed by the pressure plate against the sheet feeding roller on the sheet feeding stacker side, the friction resistances on the sheet feeding roller bearing section and between sheets may load on the sheet feeding roller at the printer side, making the sheet feeding by the sheet feeding roller instable, and making the printed letters' line spaces ununiform on the sheet.

Further, DE3442915A is known disclosing a sheet feeding mechanism to feed sheets one at a time in an office printing apparatus.

This sheet feeding mechanism is provided with a control mechanism for the printing mechanism to rotate a separating roller via a drive mechanism and to move the sheet stuck back into the drive jointing mechanism.

This sheet feeding mechanism needs a gear (forming a part of the drive mechanism) with a peripheral length corresponding to the sheet length or cam (forming a part of the control mechanism). Therefore, to print a long-size sheet, the gear size must be larger. And, when the distance between the magazine and the printing mechanism is large, the sector's (forming a part of the drive mechanism) radii must be increased, and the above gear or cam diameter must be made large, thus the sheet feeding apparatus cannot be made small. Further, when the gear or cam diameter is determined to conform to a long-sized sheet, a time of 1 cycle is same with when a short-sized one is used, and this is very inefficient to print a large volume. For example, when the switch is turned off because a sheet clogs with the tappet (forming a part of the control mechanism) having the raised part of the above cam on its back end (the state that the supporting part retracts, and the separating roller and the stacked sheet are separated), to resume printing it is necessary to return the above tappet and the cam to the normal start position, which is a troublesome work. If they are not returned, the sheet is not fed smoothly, causing inferior printing.

SUMMARY OF THE INVENTION

An object of the invention is to provide an automatic sheet feeding apparatus capable of providing clear periphery of printed letters and easily readable printed characters.

Another object of this invention is to reduce sheet feeding load which applies when feeding the sheet on the printer side and realizing safe and secure sheet feeding.

Also another object of the invention is to provide an automatic sheet feeding apparatus capable of realizing the backward movement of the pressure plate and its holding at a low cost and making the apparatus small and light.

Further another object of this invention is to provide an automatic sheet feeding apparatus capable of moving the pressure plate backward to make the gap between the stacked sheets and the sheet feeding roller at a certain level regardless of the sheet volume accommodated in the stacker and without using another structured drive source.

A still further object of this invention is to provide an automatic sheet feeding apparatus capable of moving the pressure plate backward to make a gap between the stacked sheets and the sheet feeding roller at a certain level regardless of the sheet volume accommodated in the stacker and without using another structured drive source, and stopping the backward movement of the pressure plate when sheets exceeding the optimum volume are accommodated in the sheet feeding stacker.

DESCRIPTION OF THE PREFERRED EMBODIMENT OF THE INVENTION

Figure 1:
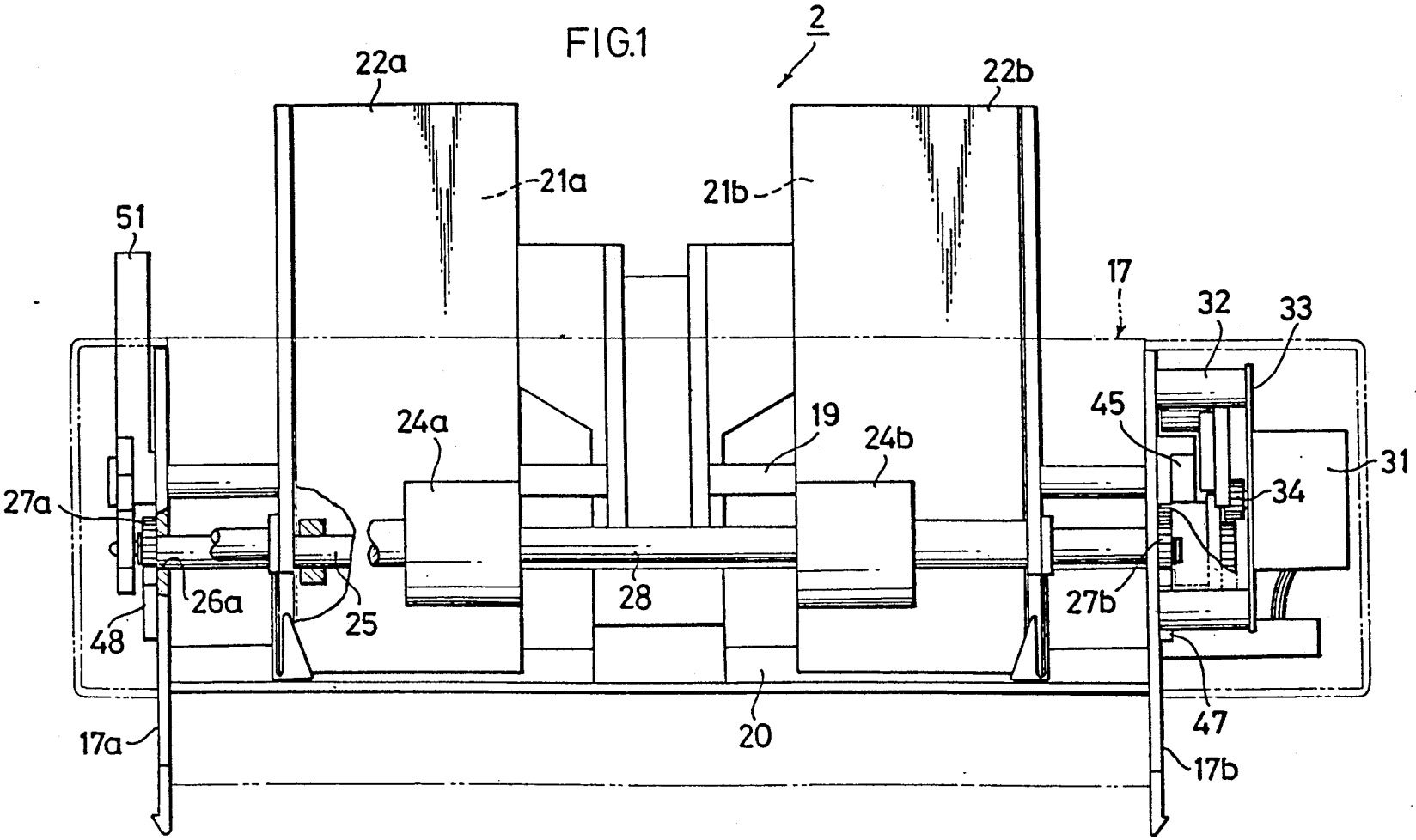
FIG. 1 is a partially cutaway front view showing one embodiment of the automatic sheet feeding apparatus according to this invention.
Figure 2:
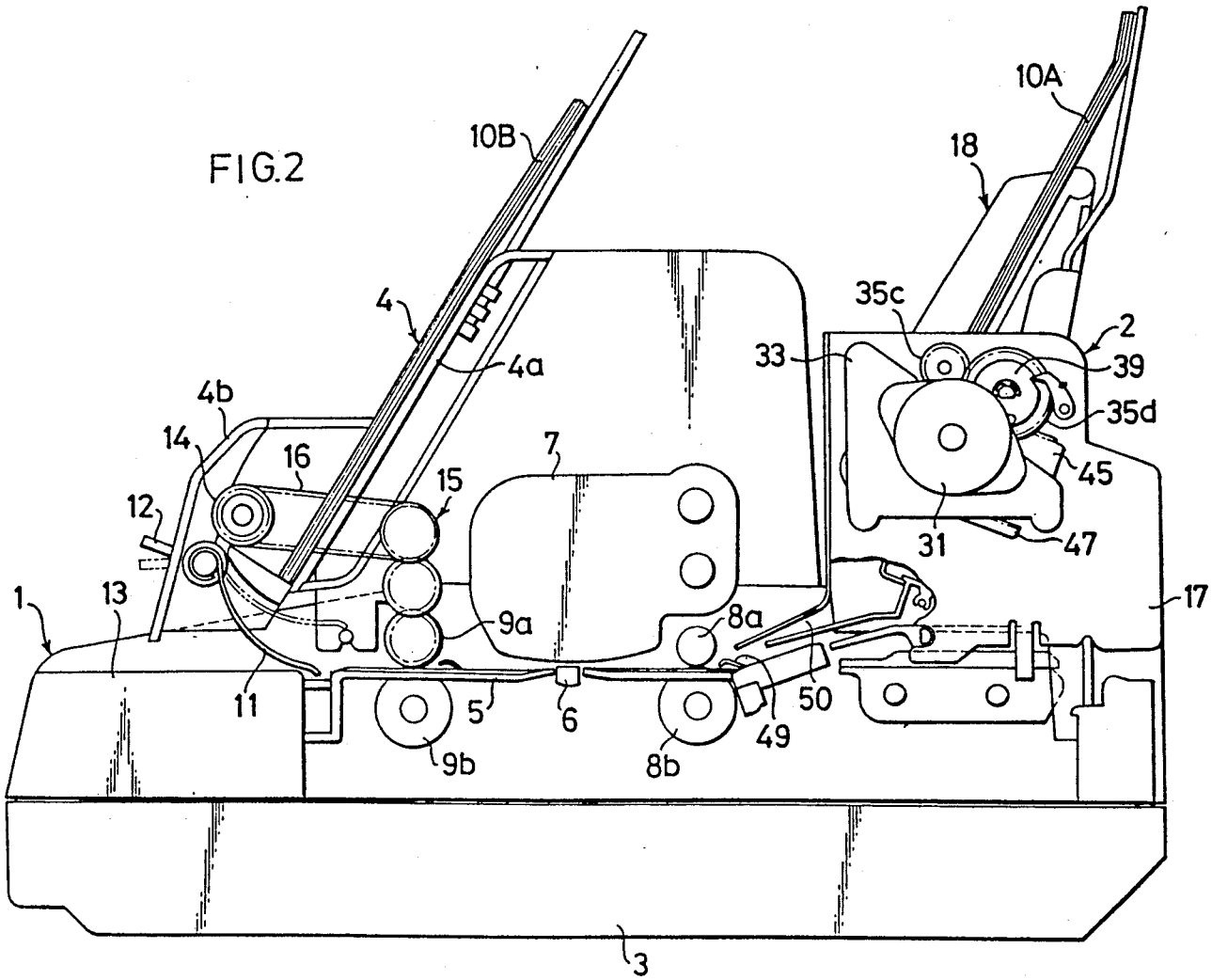
FIG. 2 is a partially cutaway side view of the printer unit with the automatic sheet feeding apparatus of this invention mounted.
Figure 3:
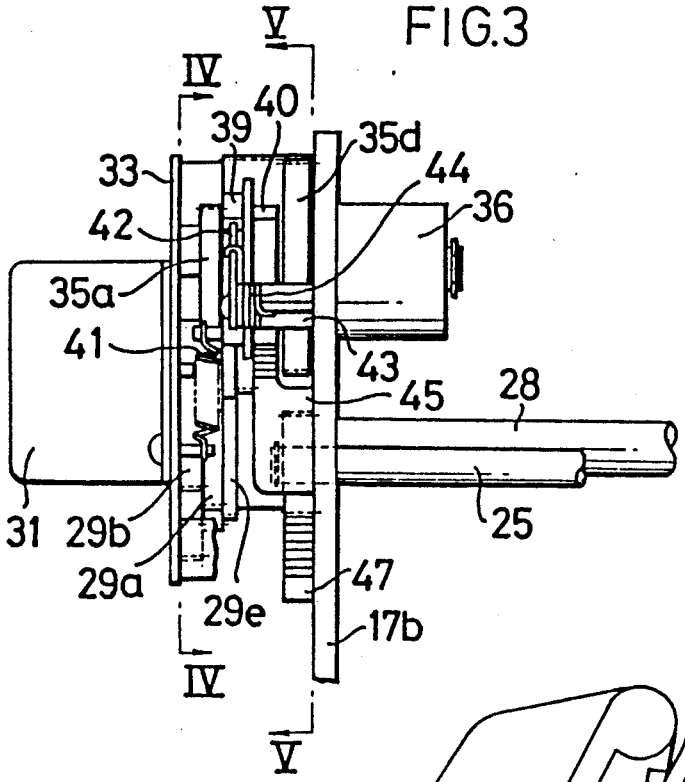
FIG. 3 is a side view of the sheet feeding motor and drive mechanism in the sheet feeding unit according to one embodiment of this invention.

In FIG. 1 and FIG. 2, 1 stands for a printer unit, 2 for an automatic sheet feeding unit detachably mounted on the printer unit 1.

The printer unit 1 is provided with a printer body 3 as shown in FIG. 2 and a discharge sheet stacker 4 which is detachable mounted on the printer body 3.

The printer body 3 has a horizontally arranged sheet guide plate 5 from the automatic sheet feed unit 2 in the direction of the discharge sheet stacker 4, a flat topped platen 6 disposed at the middle of the paper guide plate 5 to cross at right angles the longitudinal direction of the paper guide plate 5, and a print head 7 above the platen 6. On the sheet introducing end of the paper guide plate 5 positioned before the platen 6, a pair of sheet feeding rollers 8*a*, 8*b* are disposed vertically and mutually in contact to feed a sheet 10A from the automatic sheet feeding unit 2 to the print head 7. Further at the end portion of the sheet guide plate 5 positioned behind the platen 6, a pair of sheet feeding rollers 9*a*, 9*b* are disposed vertically and mutually in contact to send the printed sheet 10B to the discharge sheet stacker 4. These sheet feeding rollers 8*a*, 8*b* and 9*a*, 9*b* are rotated with a motor not shown.

The above discharge sheet stacker 4 is provided with a sheet guide 11 to lead the printed sheet 10B from the sheet feed rollers 9*a*, 9*b* to a collection section 4*a* of the discharge sheet stacker 4. One end of this sheet guide 11 is pivottably mounted on a stacker frame 4*b*, and an operation lever 12 protruding from the stacker frame 4*b* is made to switch between two positions one shown in a solid line and the other in 2-dot and dash line, and also when the sheet guide 11 is in the position shown in solid line, the printed sheet 10B is guided to the discharge stacker 4, and when in the position shown in the 2-dot and dash line, the sheet 10B is discharged out of the printer body 3 through a front sheet discharge path 13 formed on the printer body 3. And, 14 is a sheet discharge roller disposed rotatably on the stacker frame body 4*b* close to the pivoting base of the sheet guide 11. This sheet discharge roller 14 and the sheet feed roller 9*a* are connected via a gear train 15 and a geared belt 16 mounted on the stacker frame body 4*b* and transmit the rotation of the sheet feed roller 9*a* to the sheet discharge roller 14, thereby sending the printed sheet 10B guided by the sheet guide 11 into the collection section 4*a*.

Now, the automatic sheet feeding unit 2 will be described below.

The automatic sheet feeding unit 2, as shown in FIG. 1 and FIG. 2, is provided with a frame body 17 which is detachably set on the printer unit 1 and a sheet supply stacker 18 which accommodates as stacked unprinted sheets 10A in a tilted state.

Figure 10:
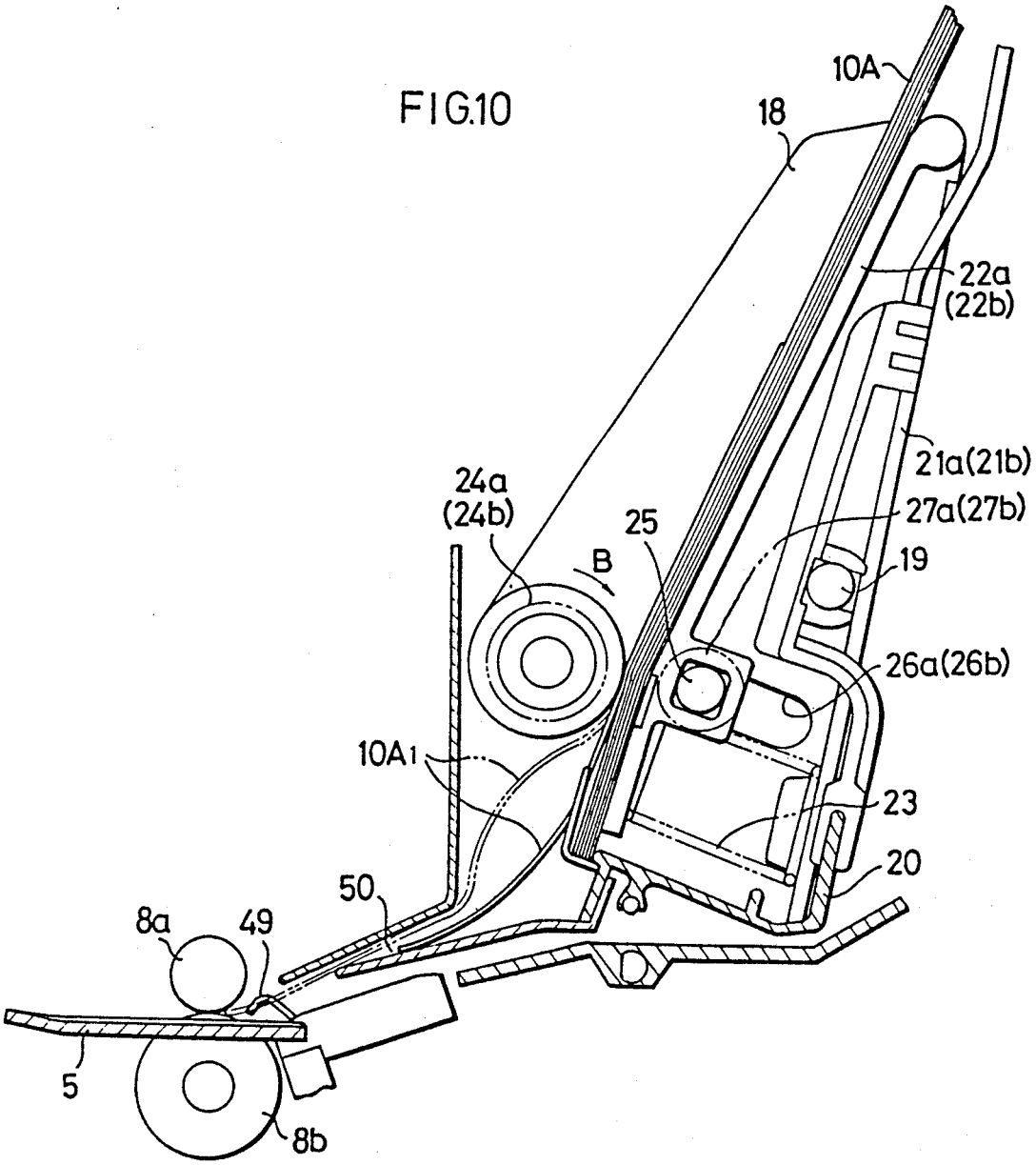
FIG. 10 is a vertical side view showing a magnified sheet feeding stacker in one embodiment of this invention.

The sheet supply stacker 18, as shown in FIG. 1 and FIG. 10, has particular supporting plates 21*a*, 21*b* which are supported freely movably along the longitudinal direction by a guide rod 19 and a guide bar 20 horizontally fixed between the right and left side plates 17*a*, 17*b* forming the frame body 17 and pressure plates 22*a*, 22*b* which are attached to be freely movable back-and-forth to the top of each supporting plate 21*a*, 21*b*. These pressure plates 22*a*, 22*b* are kept energized forward by a pushing spring 23 existing between the locking bottom parts of the supporting plates 21*a*, 21*b* and the opposite supporting plates 21*a*, 21*b* so that the sheets 10A accommodated as stacked on the pressure plates 22*a*, 22*b* are pressed against the sheet feeding rollers 24*a*, 24*b* which will be described afterward. And the locking bottom parts of the plates 22*a*, 22*b* are provided with a pressure plate shaft 25 which horizontally passes through them, whose both ends are protruded outside the side plates through oblong guide openings 26*a*, 26*b* (see FIG. 1 and FIG. 4) which are formed in the right and left side plates 17*a*, 17*b*. These protruded ends are fixed with pinions 27*a*, 27*b* (see FIG. 1 and FIG. 4).

Figure 6:
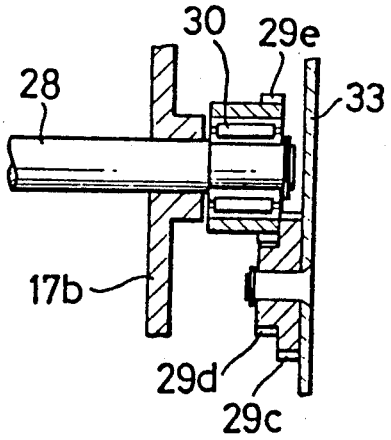
FIG. 6 is a cross-sectional view showing the details of the one-way bearing and the sheet feeding roller axis in one embodiment of this invention.

The above sheet feed rollers 24*a*, 24*b* are mounted on a roller shaft 28 (see FIG. 1) rotatably mounted horizontally between the right and left side plates 17*a*, 17*b* so that they are movable in the axial direction only. And, one end of the roller shaft 28 is attached with a gear 29*e* consisting the rotation transmitting gear train as shown in FIG. 6 via a one-way bearing 30 which transmits the rotation in one direction only.

Figure 4:
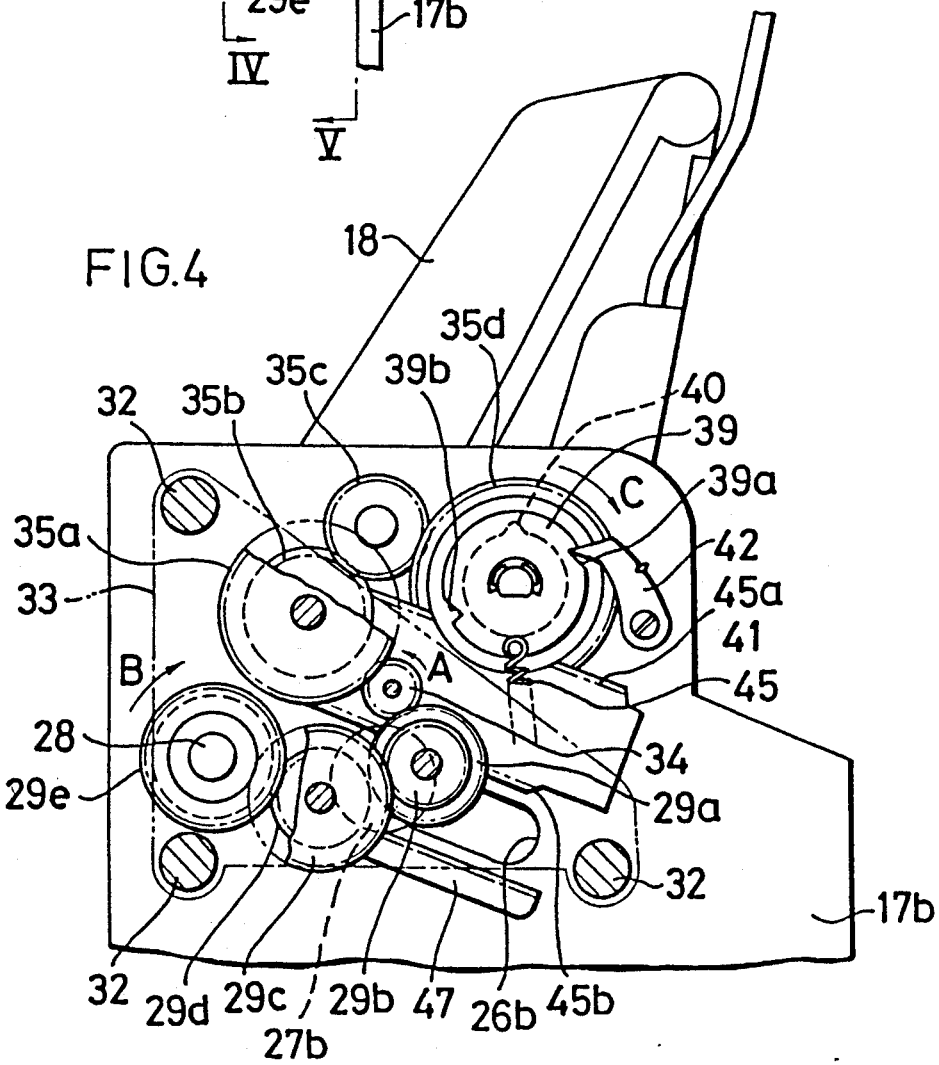
FIG. 4 is a cross-sectional view taken on line IV—IV of FIG. 3.
Figure 5:
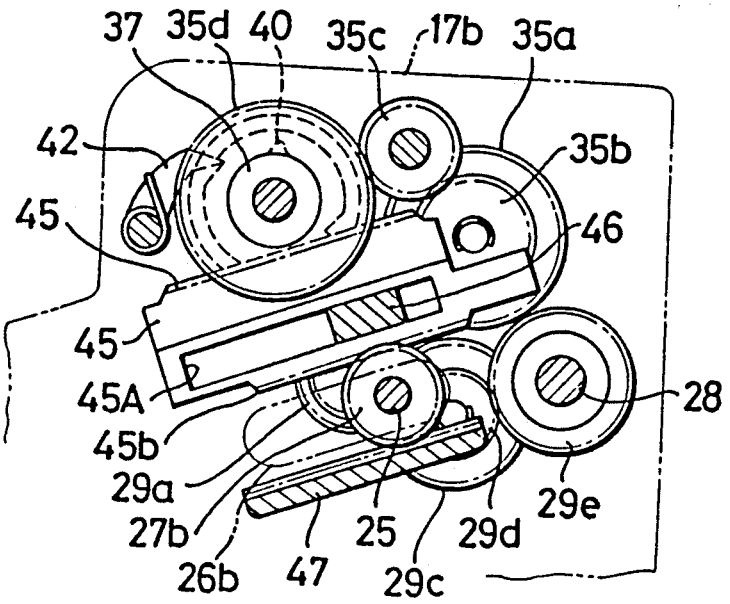
FIG. 5 is also a cross-sectional view taken on line V—V of FIG. 3.

In FIGS. 1 to 3, 31 is a sheet feeding motor which also works to move the pressure plates 22*a*, 22*b* backward. This sheet feeding motor 31 is fixed to a support plate 33 which is mounted in parallel with the right side plate 17*b* with a plurality of supports 32. And a drive gear 34 is fixed to the rotating shaft, protruding inward from the support plate 33, of the sheet feeding motor 31. The inner surface of the support plate 33, as shown in FIGS. 4 and 5, has gears 29*a*–29*d* rotatably mounted with a shaft, which form the rotation transmission gear train for the sheet feeding rollers 24*a*, 24*b*. The gear 29*a* of this gear train is engaged with the drive gear 34, and the gear 29*d*, as shown in FIG. 6, is engaged with a gear 29*e* attached to the sheet feeding roller shaft 28 via the one-way bearing 30.

Figure 7:
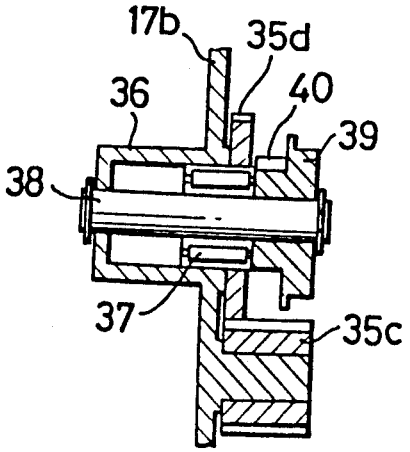
FIG. 7 is a cross-sectional view showing the details of the gear for back movement of the pressure plate in one embodiment of this invention.

The gear train for backward movement toward the pressure plates 22*a*, 22*b* consists of gears 35*a*–35*d*, among which the gear 35*a* engaged with the drive gear 34 and the gear 35*b* coaxial with the gear 35*a* are axially supported rotatably by the support plate 33, and the gear 35*c* engaged with the gear 35*b* is axially supported rotatably by the right side plate 17*b*, then the gear 35*d* engaged with the gear 35*c*, as shown in FIG. 7, is fixed to the outer ring of a one-way bearing 37 fitted in an axial case 36 mounted on the right side plate 17*b*. And, a shaft 38 is fitted in the inner ring of the one-way bearing 37, whose one end is supported by the axial case 36 and the other end is fixed with ratchet wheel 39 possessing notches 39*a*, 39*b* provided with a 180-degree phase difference in the circumferential direction, and the ratchet wheel 39 has its boss formed with a single tooth gear 40. A tension spring 41 is bridged between the periphery of the ratchet wheel 39 and the support plate 33 to resume the position of the single tooth gear 40 in the peripheral direction to the original position. Further, the right side plate 17*b* is provided with a ratchet 42 to be engaged with the notch 39*a* or 39*b* to prevent the ratchet wheel 39 from rotating reversely. That is to say, the ratchet 42 is rotatably mounted with a stud bolt 43 to retain the retracting position of the pressure plates 22*a*, 22*b*. This ratchet 42 is energized in the direction to be kept engaged with the notch 39*a* or 39*b* by the torsion spring 44.

In FIGS. 1, 3 to 5, and 8, a movable rack plate 45 for backward operation of the pressure plate is disposed above the oblong guide opening 26*b* for the pressure plate shaft opposing the support plate 33 of the right side plate 17*b*, and a sliding groove 45A formed in the longitudinal direction of the movable rack plate 45 is engaged with a convex guide part 46 protruded from the right side plate 17 so as to be slidably supported in the longitudinal direction of the oblong opening 26*b*. Further, a rack gear 45*a* formed at the top edge of the movable rack plate 45 is designed to intermittently engage with the single tooth gear 40 formed on the boss of the ratchet wheel 39, and a rack gear 45*b* formed at the bottom edge is engaged with the pinion 27*b* fixed to the pressure plate shaft 25. A stationary rack 47 disposed along but beneath the oblong opening 26*b* to the right side plate 17*b* is engaged with the pinion 27*b* from below it. Further, the left side plate 17*a* is provided with a stationary rack 48 along and below the oblong opening 26*a* for guiding the pressure plate shaft. This stationary rack 48 is engaged with a pinion 27*a* fixed to the pressure plate shaft 25.

In FIG. 2, 49 stands for a sheet sensor disposed close to the preceding sheet feed rollers 8*a*, 8*b*, 50 for a sheet guide path for guiding the sheet 10B fed out of the automatic sheet feed unit 2 to enter between the sheet feed rollers 8*a*, 8*b*, and 51 for a pressure plate release lever.

Then, the operation of the embodiment structured as described above will be disclosed with reference to FIG. 1 to FIG. 16.

Figure 8:
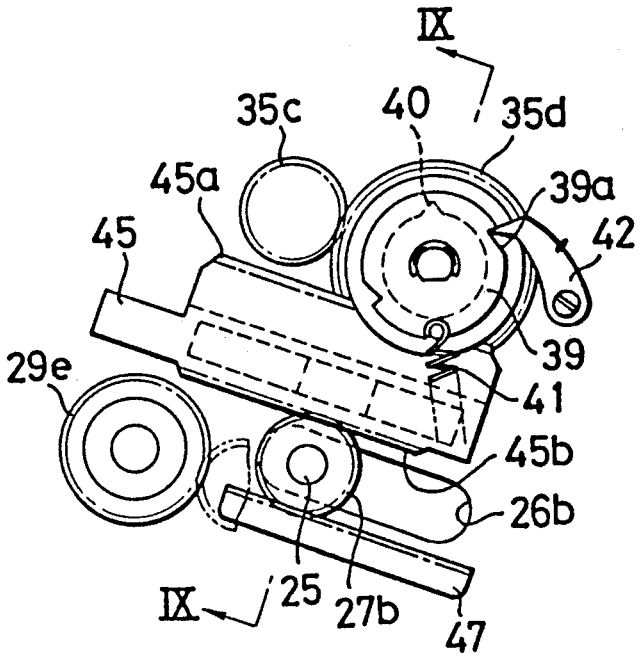
FIG. 8 is a side view of a mechanism moving the pressure plate backward in one embodiment of this invention.
Figure 9:
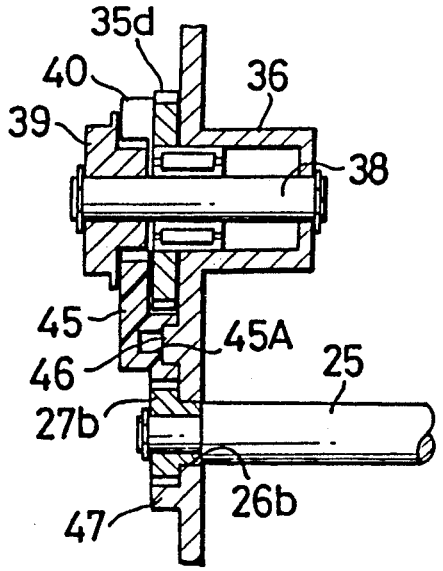
FIG. 9 is a cross-sectional view taken on line IX—IX of FIG. 8.

The pressure plates 22*a*, 22*b*, when a sheet is started to be fed into the printer unit 1, are pressed toward the sheet feed rollers 24*a*, 24*b* by the pushing spring 23 as shown in FIG. 10, thereby pressing the entire stacked sheets 10A set on the pressure plates 22*a*, 22*b* against and keeping in contact with the sheet feed rollers 24*a*, 24*b*. Then, the pressure plate shaft 25 integral with the pressure plates 22*a*, 22*b* and the pinions 27*a*, 27*b* and the movable rack plate 45 engaged with the pinion 27*b* are held at the advanced position as shown in FIG. 8 (this advanced position differs depending on the stacked thickness of the sheets 10A set on the pressure plates 22*a*, 22*b*), and the ratchet wheel 39 and the single tooth gear 40 are retained in the original position by the tension spring 41 as shown in FIG. 8, and the ratchet 42 is engaged with the first notch 39*a* of the ratchet wheel 39.

Under the above conditions, sheet feed instructions are given from the control circuit (not shown) of the printer unit 1 to the sheet feed motor 31 to activate the same in the sheet feeding direction (positive rotating direction), thereby rotating the drive gear 34 in the direction of arrow A as shown in FIG. 4. Then the gear 29*e* at the end position of the sheet feeding gear train engaged with the drive gear 34 rotates in the direction of arrow B as shown in FIG. 4, and the gear 35*d* at the last stage of the gear train for retracting the pressure plate engaged with the drive gear 34 rotates in the direction of arrow C as shown in FIG. 4.

Rotating the gear 29*e* of the sheet feeding gear train in the direction of arrow B allows the one-way bearing 30 contact the sheet feed roller shaft 28 with the gear 29*e*, and the sheet feed roller shafts 24*a*, 24*b* are rotated in the direction of arrow B as shown in FIG. 10, then the uppermost sheet $10A_1$ of the stacked sheets 10A pressed by the rollers 24*a*, 24*b* is separated and sent in the direction of the sheet guide path 50 as shown in FIG. 10.

When the gear 35*d* of the gear train for retracting the pressure plate is rotated in the direction of arrow C as shown in FIG. 4, the one-way bearing 37 supporting it is released from the shaft 38, and since the ratchet 42 is engaged in the notch 39*a* of the ratchet wheel 39, the rotation of the gear 35*d* is not transmitted to the ratchet wheel 39, which is held in a resting state.

Under the above conditions, the sheet feed rollers 24*a*, 24*b* rotate to feed the sheet $10A_1$ to be printed to the printer unit 1, and after the sheet sensor 49 detects the leading edge of the fed sheet, when the sheet is fed for a certain extent, for example for 5 lines, the leading edge of the sheet $10A_1$ hits the interface of the sheet feed rollers 8*a*, 8*b* which are not in motion. As a result, the sheet $10A_1$ is bent as indicated by the 2-dot and dash line as in FIG. 10. Then, the leading edge of the sheet $10A_1$ comes to contact with the sheet feed rollers 8*a*, 8*b* in parallel thereto, thereby preventing that the sheet is pinched but not correctly aligned between the sheet feeding rollers 8*a*, 8*b* or skewed.

After the operation of the above sheet sensor 49, completion of the sheet feeding operation for 5 line stops the sheet feed motor 31 and activates the sheet feed roller drive motor (not shown) of the printer unit 1 to rotate the sheet feed rollers 8*a*, 8*b* (and 9*a*, 9*b*). Thus, the sheet feed rollers 8*a*, 8*b* grasp the contacted sheet $10A_1$, and for example the sheet is fed for two lines, the sheet feed rollers 8*a*, 8*b* (and 9*a*, 9*b*) stop.

When the drive motor for the sheet feed rollers 8*a*, 8*b* (and 9*a*, 9*b*) stops, the sheet feed motor 31 is ordered to rotate in the opposite direction and starts to rotate in the direction opposite to the arrow A shown in FIG. 4. Then, the last stage gear 29*e* of the gear train for sheet feeding which engages with the drive gear 34 is rotated in the direction opposite from the arrow B shown in FIG. 4, but since the one-way bearing 30 is freed from the roller shaft 28, the roller shaft 28 including the sheet feed rollers 24*a*, 24*b* does not rotate.

On the other hand, when the rotation of the drive gear 34 in the direction opposite from the arrow A shown in FIG. 4 is transmitted to the gear trains 35*a* to 35*d*, the last stage gear 35*d* is rotated in the direction opposite from the arrow C shown in FIG. 4, and the one-way bearing 37 connects the gear 35*d* and the shaft 38 and rotates the ratchet wheel 39 including the single tooth gear 40 in the direction opposite from the arrow C shown in FIG. 4 from the original position shown in FIG. 8. Here, the sheet feed motor 31 is designed to stop after the ratchet wheel 39 rotates about one half.

Figure 12:
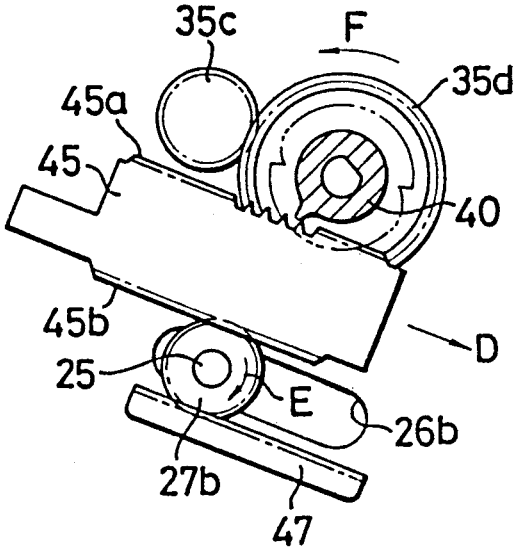
FIG. 12 to FIG. 14 are explanatory views of the operation of the mechanism for backward operation of the pressure plate.

Therefore, as the ratchet wheel 39*b* including the single tooth gear 40 rotates in the direction opposite from the arrow C shown in FIG. 4 from the original position shown in FIG. 8, the single tooth gear 40 engages with the rack 45*a* of the movable rack plate 45 as shown in FIG. 12. And, when the single tooth gear 40 is further rotated in the direction of arrow F, the movable rack plate 45 slides in the direction of arrow D as shown in FIG. 12. As the movable rack plate 45 moves in the direction of arrow D, the pinion 27*b* engaged with the rack teeth 45*b* rotates in the direction of arrow E shown in FIG. 12, and the pinion 27*b* rotates to move in the direction same with that of the movable rack plate 45 on the stationary rack 47 with its rotation. Then, the rotation of the pinion 27*b* is transmitted to the pinion 27*a* at the opposite position through the pressure plate 25, and the pinion 27*a* also rotates to move in the same direction with the pinion 27*b* on the stationary rack 48 engaged.

Figure 11:
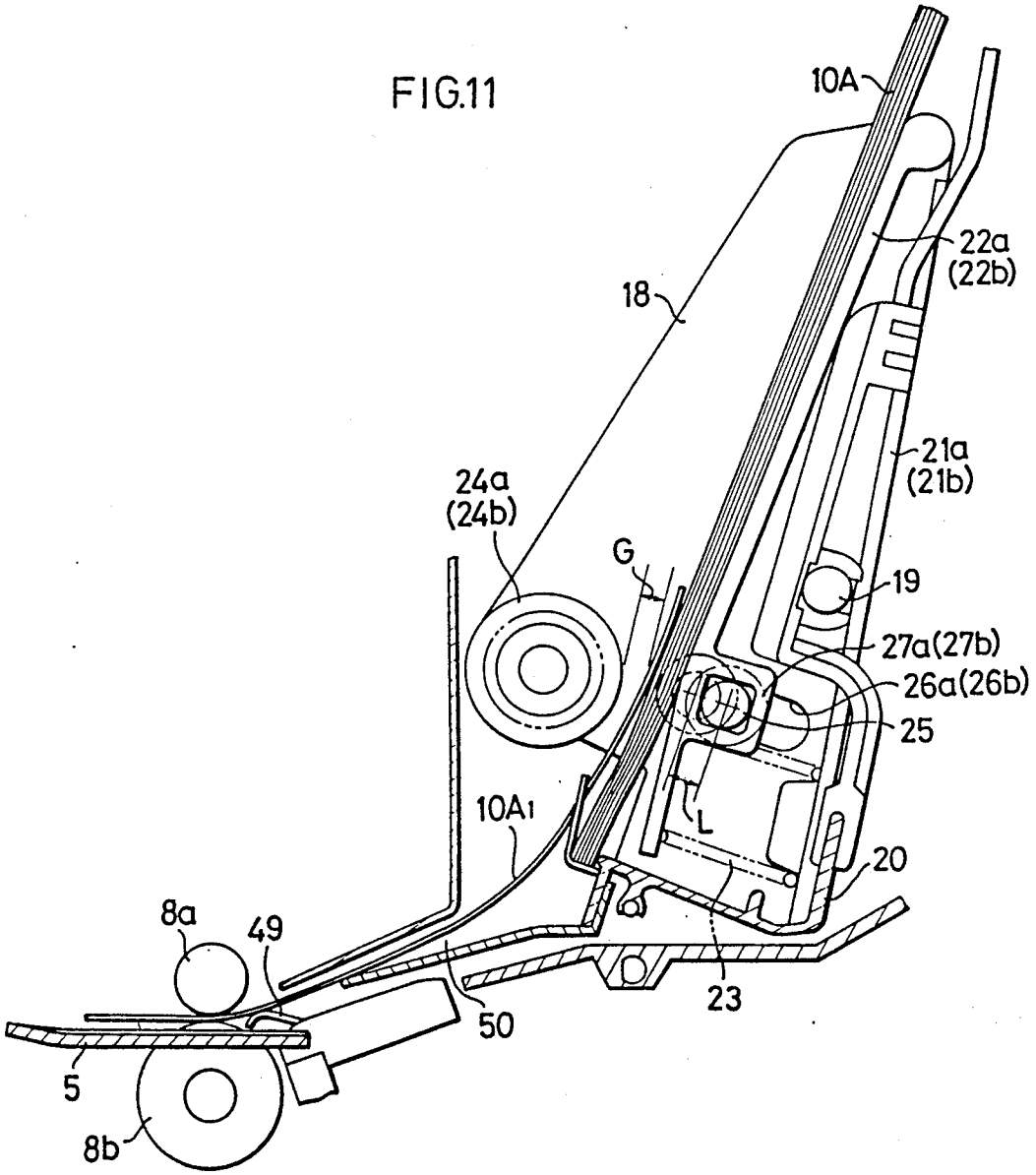
FIG. 11 is cross-sectional view for explaining the operation of the sheet feeding stacker in one embodiment of this invention.
Figure 13:
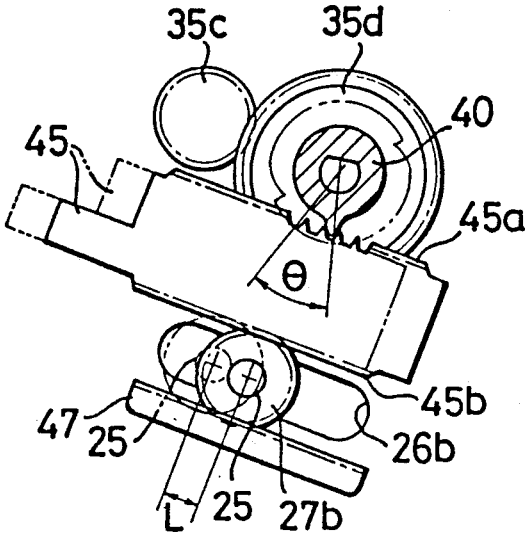

When the single tooth gear 40 rotates by the prescribed angle from the engagement starting position with the rack gear 45*a* as shown in FIG. 13, the movable rack plate 45 moves accordingly from the position indicated by the 2-dot and dash line in FIG. 13 to the position indicated by the solid line, and also the pressure plate shaft 25 moves back by L. When the pressure plate shaft 25 moves backward, the pressure plates 22*a*, 22*b* integrally made therewith move backward by L against the pushing spring 23, and as shown in FIG. 11, the sheet feed rollers 24*a*, 24*b* and the top sheet of the stacked sheets 10A is provided with a gap G therebetween. Thus, the pressing force by the pushing spring 23 against the grasped sheet $10A_1$ between the sheet feed rollers 8*a*, 8*b* is removed to reduce the sheet feeding load of the sheet feeding rollers 8*a*, 8*b*.

Figure 14:
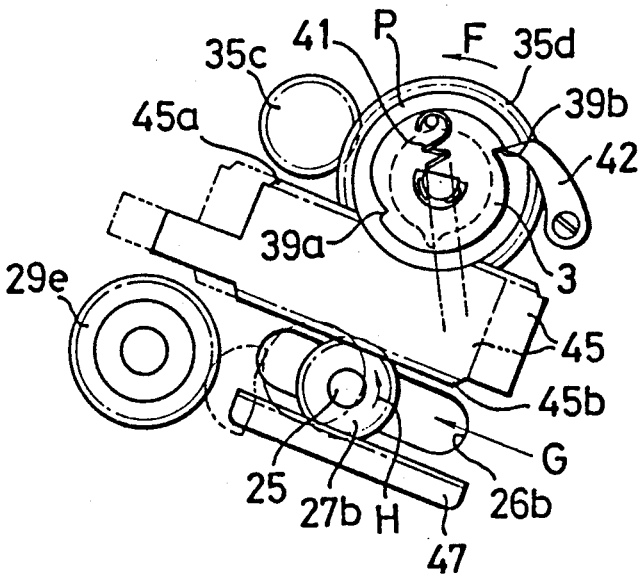

And, under the state that the ratchet wheel 39 rotates about one half and stops by the reverse rotation of the sheet feed motor 31, as shown in FIG. 13 the single tooth gear 40 is engaged with the rack gear 45*a*, and the ratchet 42 is at rest in the notch 39*b* of the ratchet wheel 39 as shown in FIG. 14. Therefore, the pressure plates 22*a*, 22*b* are locked at the retracted position, and the pressure plates 22*a*, 22*b* are prevented from being pushed back to the sheet feed rollers 24*a*, 24*b* by the spring force of the pushing spring 23.

Reverse rotating of the sheet feed motor 31 terminates the retracting operation of the pressure plates 22*a*, 22*b*, and the printer unit 1 actually works to print by intermittently rotating the sheet feed rollers 8*a*, 8*b* and 9*a*, 9*b* by a printer motor (not shown) to feed a sheet and operate the print head 7. After the end part of the sheet $10A_1$ sent into the printer unit 1 which has passed the sheet sensor 49 is detected by the sensor 49, the sheet $10A_1$ is printed, then the printer motor is instructed to discharge the sheet. Particularly, later staged sheet feed rollers 9*a*, 9*b* and the discharge sheet roller 14 are successively rotated to send the printed sheet 10B into the collection section 4*a* of the sheet discharge stacker 4. When the sheet discharge completes into the discharge sheet stacker 4, the printer motor stops and at the same time the sheet feed motor 31 is instructed to rotate reversely and rotates in the reverse direction. Then, the sheet feed motor 31 rotates one fourth by the ratchet wheel 39 and stops again.

When the sheet feed motor 31 is rotated reversely, the rotation of the drive gear 34 is transmitted to the ratchet wheel 39 and the single tooth gear 40 via the gear trains 35*a*–35*d* for reverse operation, then the ratchet wheel 39 and the single tooth gear 40 are rotated about one fourth in the direction of arrow F from the state shown in FIG. 14. Accordingly, the single tooth gear 40 engaged with the rack gear 45*a* of the movable rack plate 45 is released from the rack gear 45*a*, and the locked movable rack plate 45 is unlocked, pushing back the pressure plates 22*a*, 22*b* toward the sheet feed rollers 24*a*, 24*b* by means of the pushing spring 23. This pushing back operation rotates the pinions 27*a*, 27*b* in the direction of arrow G on each of stationary racks 47, 48 from the state shown in FIG. 14. The rotation of the pinion 27*b* in the direction of arrow H by the above action resumes the movable rack plate 45 to the state indicated by the 2-dot and dash line from the state shown in the solid line in FIG. 14. Thus, the stacked sheets 10A on the pressure plates 22*a*, 22*b* are pushed against the sheet feed rollers 24*a*, 24*b*.

When the ratchet wheel 39 is rotated about one fourth in the direction of arrow $B_2$ from the state shown in FIG. 14, a straight line 52 connecting a pin 41*a* and a stationary pin 41*b* of the ratchet wheel 39 is dislocated to the left side of the line 53 connecting the stationary pin 41*b* and the ratchet wheel shaft 38. The ratchet wheel 39 including the single tooth gear 40 is rotated in the direction of arrow $B_2$ shown in FIG. 15 by the spring force of the tensile spring 41, and the pin 41*a* moves from the position $P_1$ to $P_3$ via $P_2$. The pin 41*a* moves to the position $P_3$ because the ratchet wheel 39 overruns in the direction of arrow $B_2$ by the tensile inertia force of the tensile spring 41, and when the spring force of the tensile spring 41 applies to the ratchet wheel 39 in the state of the position $P_3$, the one-way bearing 37 connects the shaft 39 and the gear 35*d* to prevent the rotation in the direction of arrow $B_1$.

Figure 15:
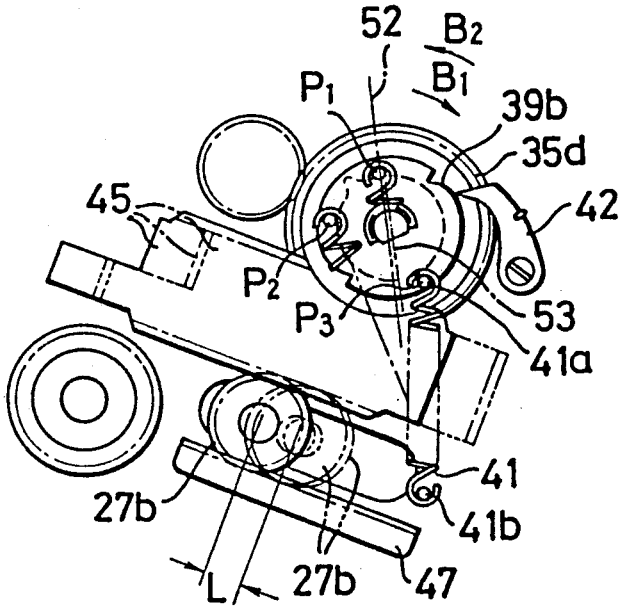
FIG. 15 is an explanatory view showing the operating conditions of the pressure plate retracting mechanism and gear in one embodiment of this invention.

Therefore, when the sheet feed unit enters the next sheet feeding cycle to activate the sheet feed motor 31 in the positive direction (the direction of arrow A in FIG. 4) and the gear 35*d* is accordingly rotated in the direction of arrow $B_1$ shown in FIG. 15, the ratchet wheel 39 is rotated together in the same direction until the notch 39*a* is engaged with the ratchet 42 (when the gear 39*d* rotates in the direction of arrow $B_1$, the shaft 38 is free thanks to the one-way gear 37 but it is rotated together because the shaft 38 and the ratchet 39 fixed thereto are applied with substantially no load). Thus, the pressure plates 22*a*, 22*b* are moved backward so that the single tooth gear 40 is moved back to the original position as shown in FIG. 4 and the single tooth gear 40 is always engaged with the movable rack plate 45 at a certain angled timing, and the gap G between the sheet feed rollers 24*a*, 24*b* and the stacked sheets is remained to be a certain value.

The above series of operation is repeated for each sheet at a time for the stacked sheet in the sheet feed unit as follows.

Figure 16:
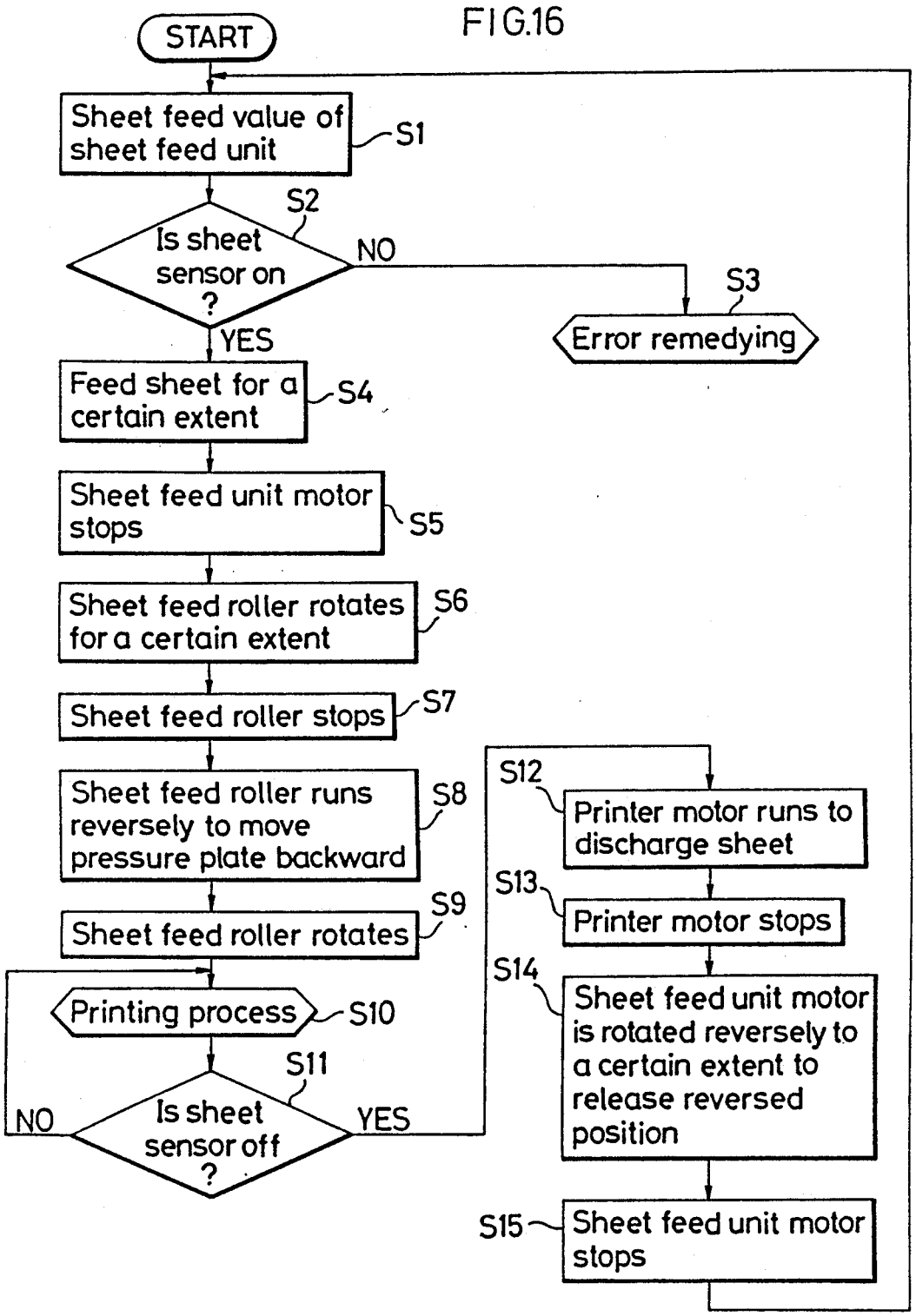
FIG. 16 is a flowchart schematically showing the operating process of sheet feeding, backward movement, and printing in one embodiment of this invention.

FIG. 16 is a flowchart showing a series of procedures of the above described sheet feeding and printing.

In FIG. 16, step S1 is a step to feed a sheet to the printer unit 1 by the automatic sheet feed unit 2, and step S2 is a step to judge by the sheet sensor 49 whether or not the sheet 10A has been sent into the printer unit 1. If the sensor indicates "NO" here, the procedure goes to the next step S3 to make an error remedying process. If "YES", the next step S4 is effected to further operate the automatic sheet feed unit 2 to feed the sheet to a prescribed extent (for 5 lines), causing distortion in the fed sheet as shown in FIG. 10. Then step S5 is a process to stop the automatic sheet feed unit 2. Step S6 is a process that the printer motor of the printer unit 1 operates to rotate the sheet feeding roller to feed the sheet by a certain length, for example for 2 lines, and the next step S7 is a process to stop feeding the sheet by the printer unit 1 after feeding the sheet for a certain distance. After the step S7, step S8 is effected to operate the automatic sheet feed unit reversely, and the pressure plates 22*a*, 22*b* are moved backward. Then, in the next step S9, the printer unit 1 is operated to feed a sheet, and the next step S10 effects the printing process. Step S11 is a process to judge whether or not the sheet 10A sent into the printer unit 1 has passed the sheet sensor 49. If "NO", the procedure returns to step S10. When the sheet 10A is judged as passed through, it goes to the next step S12, and the printer motor of the printer unit 1 is operated to discharge the printed sheet 10B. After discharging the sheet 10B, step S13 stops the printer unit 1. In the next step S14, the automatic sheet feed unit 2 is reversely operated again to return the pressure plates 22*a*, 22*b* locked in the retracted position to the sheet feedable state. And, step S15 stops the reverse operation of the automatic sheet feed unit 2.

Figure 17:
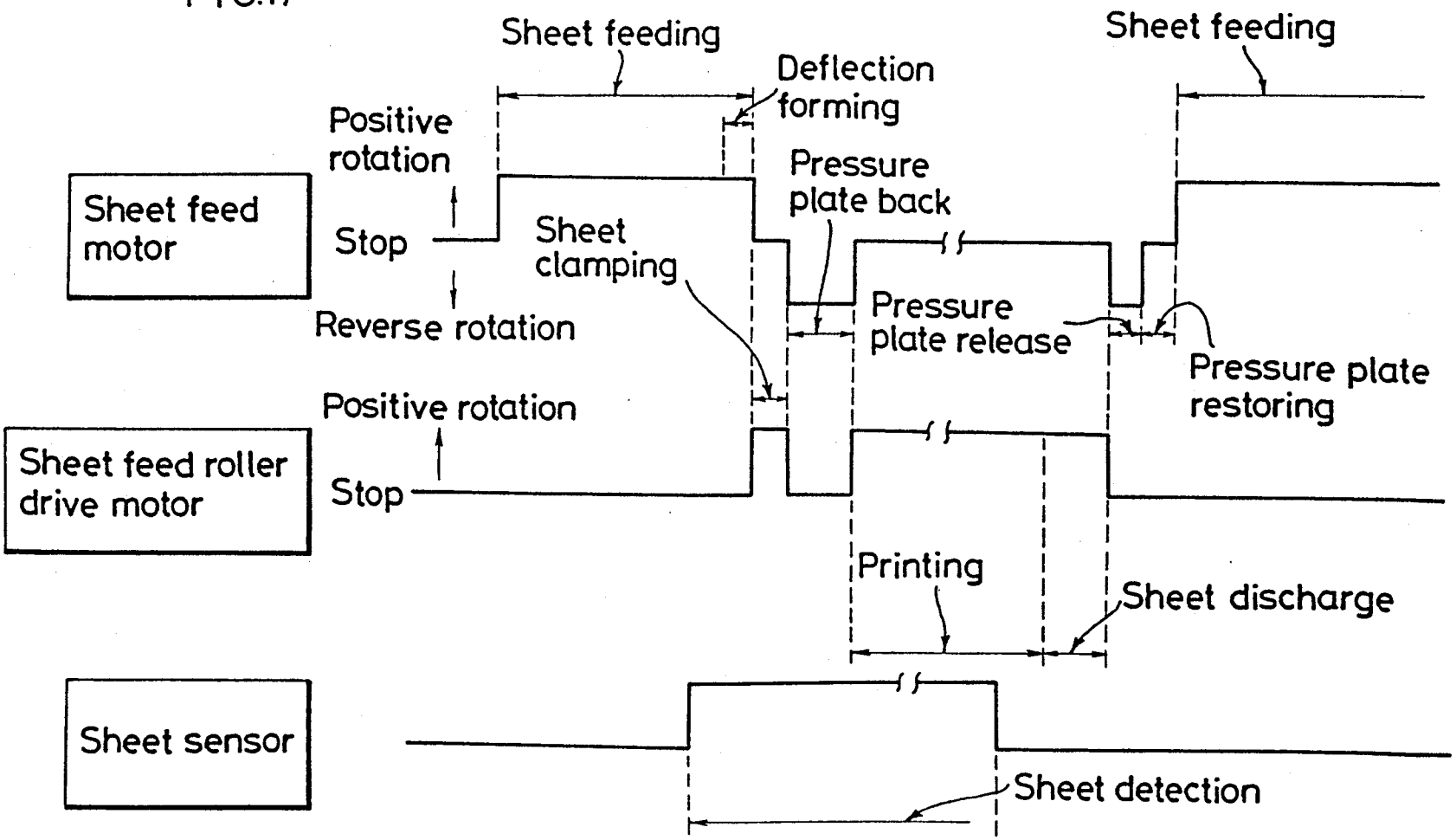
FIG. 17 is a time chart showing the operation timing of the sheet feeding motor, sheet feeding roller drive motor and sheet sensor corresponding to FIG. 16.

FIG. 17 is a time chart showing the operating conditions of the sheet feed motor of the sheet feed unit, the sheet feeding motor of the printer unit and the sheet sensor each corresponding to the operation procedures shown in the flowchart of FIG. 16.

In the abovementioned embodiment, the positive rotation of the sheet feed motor 31 rotates the sheet feed rollers 24*a*, 24*b* in the sheet feeding direction to send the sheet 10A on the pressure plates 22*a*, 22*b* into the printer unit 1, and when the end part of the sheet 10A is caught to a certain length between the sheet feed rollers 8*a*, 8*b* of the printer unit, the sheet feed motor 31 is reversely rotated to a certain extent to slide the movable rack plate 45 by the single tooth gear 40, and at the same time the pinion 27*a* and pinion 27*b* which are engaged with the movable rack plate 45 are rotated to move along the stationary racks 47, 48 to force the pressure plates 22*a*, 22*b* to move backward against the pressure spring 23, and since the stacked sheets are designed to be separated from the sheet feed rollers 24*a*, 24*b* by retaining this retracted position by the ratchet wheel 39 and its stopping ratchet 42, so that constraint force against the sheets on the sheet feed unit is lost, and the sheet feeding load on the sheet feed roller in the printer is reduced, and at the same time the sheet feed can be done safely and securely with a light contact pressure of such as like a linear contact between the sheet feed rollers 8*a*, 8*b* and 9*a*, 9*b*. Besides, since the contact pressure between the sheet feed rollers can be lowered, the sheet feed roller supporting shaft and its supporting mechanism can be made of not so tough material, and the also the roller drive motor can be made to be of a small capacity. Thus, a light and inexpensive printer can be produced.

Since the backward movement of the pressure plates and the sheet feed operation can be done with a single sheet feed motor, the automatic sheet feed unit can be made light.

Now, the backward movement of the pressure plates 22*a*, 22*b* when the contents of sheets 10A accommodated in the sheet feed stacker 18 are varied will be described.

Figure 18A:
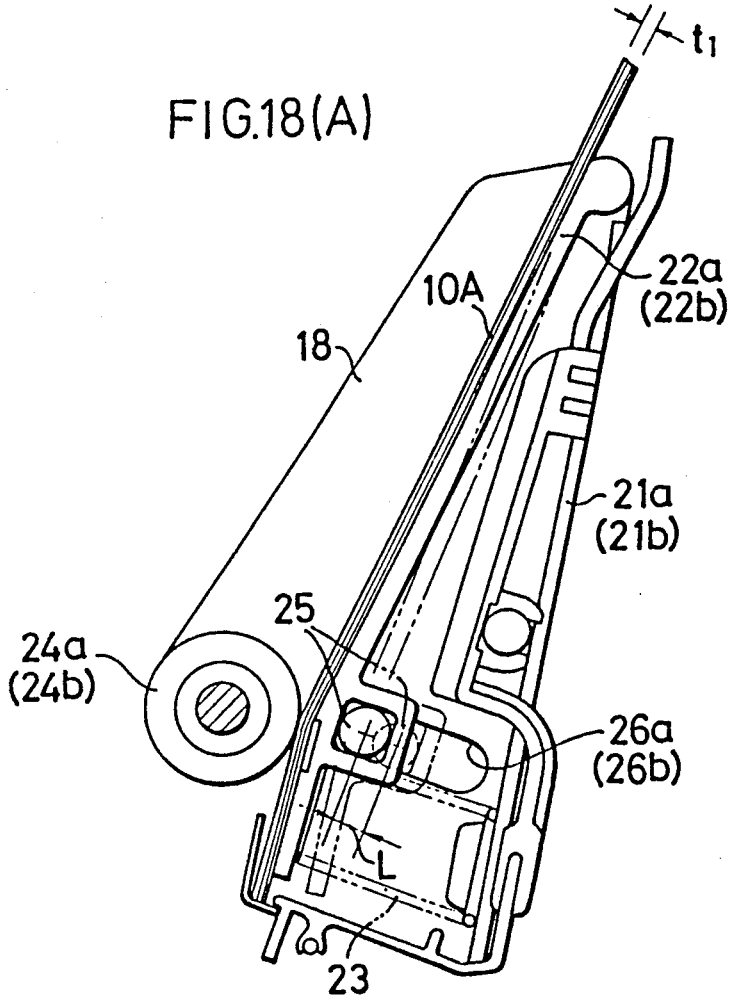
FIGS. 18 (A), 18 (B) and 18 (C) are explanatory views showing the related operation of the sheet volume accommodated in the sheet feeding stacker and the pressure plate retracting mechanism in one embodiment of this invention.
Figure 18B:
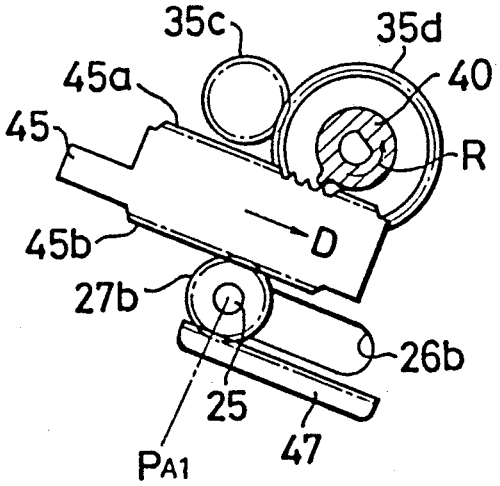
Figure 18C:
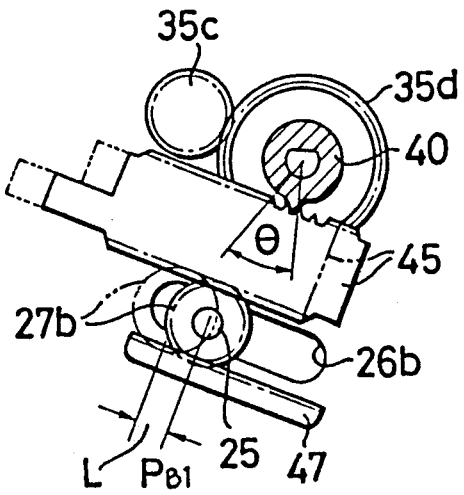

FIG. 18 (A) to FIG. 18 (C) show that the sheets in the sheet feed stacker 18 are reduced. As FIG. 18 (A) shows, when the volume of the stacked sheets 10A or its thickness is reduced to $t_1$ as indicated, the pressure plates 22*a*, 22*b* accordingly approach to the sheet feed rollers 24*a*, 24*b* depending on the thickness $t_1$, and when the pressure plates 22*a*, 22*b* push the stacked sheets 10A against the sheet feed rollers 24*a*, 24*b*, the position $P_{A1}$ of the pinions 27*a*, 27*b* is located at the front end of the stationary racks 47, 48 as shown in FIG. 18 (B). As the pinions 27*a*, 27*b* are moved to the front end of the stationary racks 47, 48, the movable rack plate 45 engaged with the pinion 27*b* is also moved toward the sheet feed roller, and the engaged position of the single tooth gear 40 to the rack gear 45*a* of the movable rack plate 45 varies. But, when the single tooth gear 40 is rotated in the direction of arrow R by the one half rotation of the gear 35*d* from the time of starting the engagement of the gear 40 as shown in FIG. 18 (B) to the end of the one half rotation of the gear 35*d* shown in FIG. 18 (C), its angle $\theta$ is almost constant, so that when the movable rack plate 45 is moved in the direction of D for a degree corresponding to the angle $\theta$, the pinion 27*b* engaged with the rack gear 45*b* rotates to move for a length L on the stationary rack 47 from the 2-dot and dash lined position to the solid lined position $P_{B1}$ shown in FIG. 18 (C). That is to say, even if the volume of sheets accommodated in the sheet feed stacker 18 is reduced, the pressure plates 22*a*, 22*b* which push the stacked sheets 10A against the sheet feed rollers 24*a*, 24*b* move for a length of L from that pushing position to backward position by almost a constant extent. As a result, the gap G formed between the sheet feed rollers 24*a*, 24*b* and the stacked sheets 10A is almost fixed.

Figure 19A:
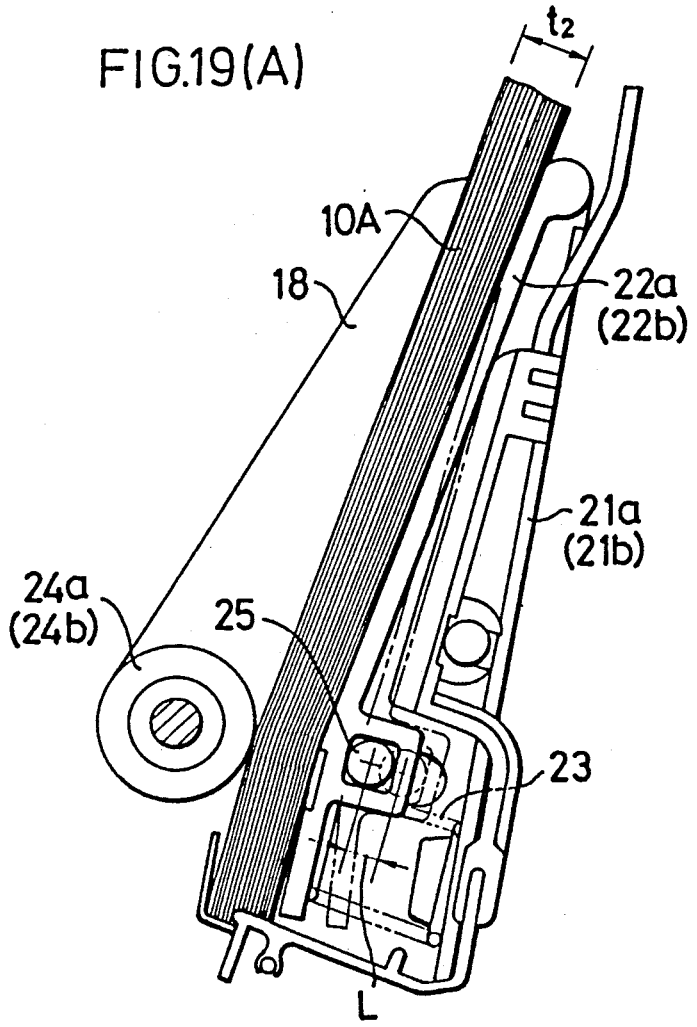
FIGS. 19 (A), 19 (B) and 19 (C) also are explanatory views showing the related operation of the sheet volume accommodated in the sheet feeding stacker and the pressure plate retracting mechanism in one embodiment of this invention.
Figure 19B:
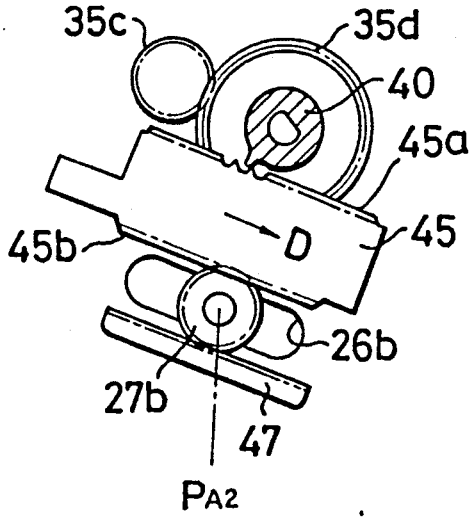
Figure 19C:
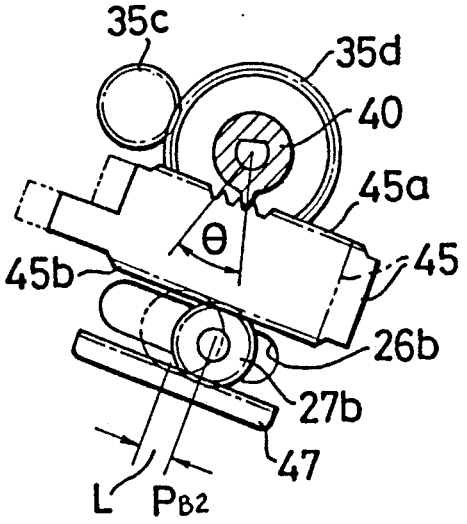

FIG. 19 (A) to FIG. 19 (C) show a state that a large volume of stacked sheets 10A in the sheet feed stacker 18 and the thickness $t_2$. As FIG. 19 (A) shows, when the stacked sheets 10A has the thickness $t_2$, the pressure plates 22*a*, 22*b* are accordingly separated from the sheet feed rollers 24*a*, 24*b*, and the position $P_{A2}$ of the pinions 27*a*, 27*b* when the pressure plates push the stacked sheets 10A against the sheet feed rollers 24*a*, 24*b* are positioned at about the middle of the stationary racks 47, 48 as shown in FIG. 19 (B). And, as the pinions 27*a*, 27*b* are positioned at the middle of the stationary racks, the movable rack plates 45 engaged with the pinion 27*b* moves away from the sheet feed roller. But, when the pressure plates move backward, the single tooth gear 40 is rotated one half in the direction of arrow R from the original position, and since the angle $\theta$ from the engagement starting point shown in FIG. 19 (B) to the end point of one half rotation shown in FIG. 19 (C) is almost constant, the movable rack plate 45 is moved in the direction of arrow D for the corresponding distance, and the pinion 27*b* is also rotated to move in the same direction for the length L in the same way as in FIG. 18. As a result, even if the sheets are stacked in a large volume, the backward movement of the pressure plates 22*a*, 22*b* keeps the gap G formed between the sheet feed rollers 24*a*, 24*b* and the stacked sheets 10A at a constant value.

As described above, the changes in the volume of the stacked sheets 10A in the sheet feed stacker 18 provides the operation same as in the previous embodiment and, the following functions and effects are exhibited.

The pinions 27*a*, 27*b* disposed at both ends of the pressure plate shaft 25 are respectively engaged with the stationary racks 47, 48, and the movable rack plate 45 slidably operated by the single tooth gear 40 is designed to engage with the pinion 27*b*, so that according to the sheet volume stacked, the sheet pushing position of the pressure plates is automatically corrected. Accordingly, without using another drive source, and regardless of the stacked volume of sheets in the sheet feed stacker 18, the sheet feed rollers 24*a*, 24*b* can form a gap between the pressure plates which have been moved backward and the stacked sheets 10A at a constant value, and also the stacked sheet moves only a small distance, preventing disorder and buckling of the sheets due to such movement.

Then, conventional actuator, sensor, etc. for backward movement only are not required, and the structure becomes simple, and its operation is correct, being able to preventing a time loss thereby.

Besides, the backward movement of the pressure plates and sheet feed operation are effected by a single sheet feed motor, resulting in lightening the automatic sheet feed unit.

In the above embodiment, the sliding groove 45A is applied with a relatively high viscosity grease and other viscous oil to provide an oil damper function in sliding of the movable rack plate 45.

Thus, when the pressure plates 22*a*, 22*b* are returned, the sliding groove 45A of the movable rack plate 45 which slides to return accordingly and the guide convex 46 are applied with the viscous oil with a high viscosity. This viscous oil gives an oil dumper function to the movable rack plate 45 and slowly move the pressure plates 22*a*, 22*b* which are pushed back by the spring force of the pushing spring 23. Thus, a sharp return of the pressure plate is prevented, and also the production of noise, vibration and dancing of the sheets 10A in the sheet feed stacker 18 can be prevented.

When the pressure plates 22*a*, 22*b* are moved backward, the ratchet 42 engages in the notch 39*b* of the ratchet wheel 39 by being energized with the tensile spring 41 to hold the retracted position of the pressure plates. Therefore, a conventional energy source for keeping to supply power to the electromagnetic plunger is not required. Accordingly, the elongated operation of the printer from the printing operation to the sheet discharge does not cause a disadvantages such as heat generation, and the retracted position retaining means can be simply structured by a ratchet wheel and a ratchet only. Thus, the sheet feed unit can be made small and light, lowering the product cost.

Now, operation when the sheet feed stacker 18 accommodates the sheets 10A exceeding the optimum volume will be described below with reference to FIG. 20 to FIG. 23.

Figure 21:
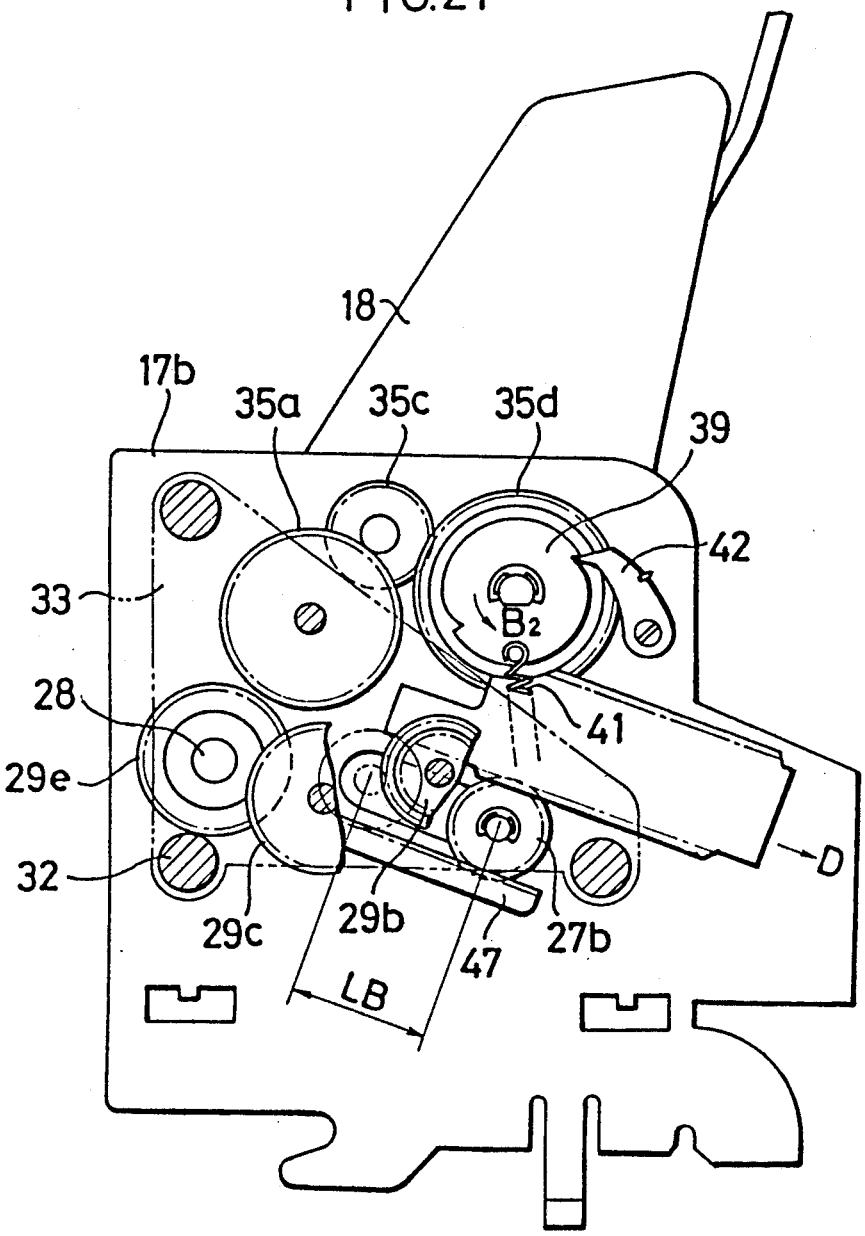
FIG. 21 is a side view of a pinion rack mechanism part showing the maximum retracted state of the pressure plate in one embodiment of this invention.

In the drawings the movable rack plate 45 for backward movement of the pressure plates is disposed on the opposite surface of the support plate 33 of the right side plate 17*b* above the oblong opening 26*b* for the pressure plate shaft guiding and supported slidably in the longitudinal direction of the oblong opening 26*b* by the guide convex 46 protruded from the right side plate 17*b*, and designed to provide an oil damper function to slide the movable rack plate 45 by applying grease or other viscous oil with a relatively high viscosity to the sliding groove 45A. And, the pinion 27*b* and the rack gear 45*a* of the movable rack plate 45 are as shown in FIG. 21 designed to engage to each other only when the value LA is smaller than LP (distance) which is obtained by deducting L from the maximum retracted length LB, where LB is the maximum retraction of the pressure plates 22*a*, 22*b* from the most advanced position (state without any sheet), L is a retracted distance (a fixed value) that the single tooth gear 40 engaged with the rack gear 45*a* moves the movable rack plate 45 backward. Therefore, when the sheets 10A exceeding an optimum volume is placed in the sheet feed stacker 18, the single tooth gear 40 is not engaged with the rack gear 45*a*. And, the rack gear 45*a* disposed at the top edge of the movable rack plate 45 is designed to engage intermittently with the single tooth gear 40 formed on the boss of the above ratchet wheel 39. Besides, the rack gear 45*b* disposed at the bottom edge of the movable rack plate 45 is engaged with the pinion 27*b* fixed to the pressure plate shaft 25. The stationary rack 47 provided along and below the oblong opening 26*b* on the right side plate 17*b* is engaged with the pinion 27*b* from its below, and the left side plate 17*a* is provided with the stationary rack 48 along and below the oblong opening 26*a* for the pressure plate shaft guide. This stationary rack 48 is engaged with the pinion 27*a* fixed to the pressure plate shaft 25.

Figure 20:
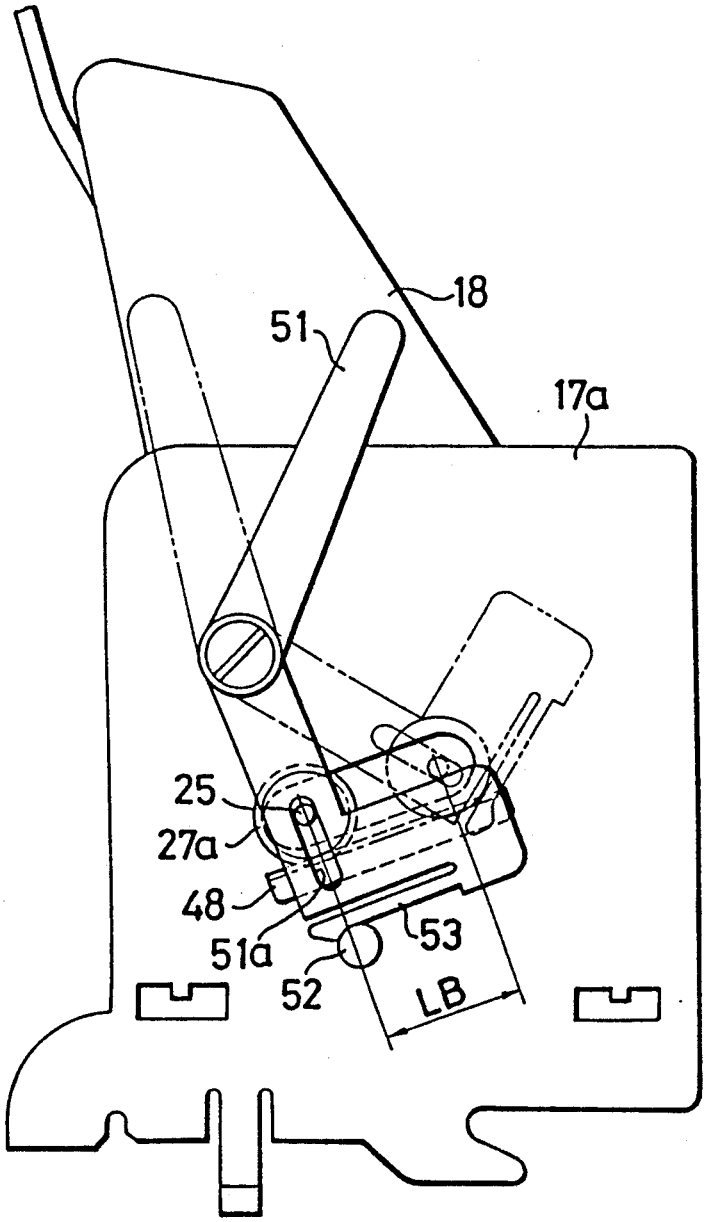
FIG. 20 is a side view of the relief lever section in one embodiment of this invention.

The release lever 51 for maximum movement of the pressure plates 22*a*, 22*b* is rotatably mounted axially to the left side plate 17*a* as shown in FIG. 20, and its bottom is connected to the pressure plate shaft 25 through the oblong opening 51*a* formed therein and also provided with a spring piece 53 disconnectable from the stud 52 protruded from the left side plate 17*a*. This spring piece 53 is connected to the stud 52 to keep the maximum retracted position of the pressure plates 22*a*, 22*b*, so that the sheets 10A can be placed in or out of the sheet feed stacker 18.

To set the sheets 10A in the sheet feed stacker 18, the release lever 51 is turned from the state indicated in the 2-dot and dash line to that in the solid line as shown in FIG. 20 to move the pressure plates 22*a*, 22*b* to the backmost position and to hold there by engaging the spring piece 52 with the stud 53. In this case, the maximum length of backward movement of the pressure plates 22*a*, 22*b* away from the sheet feed roller is LB, and as the pressure plates move backward, the pinions 27*a*, 27*b* attached to the pressure plate shaft 25 respectively rotate to move backward on the stationary racks 48, 47 as shown in FIG. 20 and FIG. 21. Thus, the movable rack plate 45 engaged with the pinion 27*b* is held in the state as moved back to the maximum extent in the direction of arrow D as shown in FIG. 21. Under this condition, a certain volume of sheets 10A is set on the reversed pressure plates 22*a*, 22*b* in the sheet feed stacker 18. Then, rotating the release lever 51 in the direction shown in the 2-dot and dash line in FIG. 20 advances the pressure plates 22*a*, 22*b* and pushes the stacked sheets 10A against the sheet feed rollers 24*a*, 24*b*.

Figure 22:
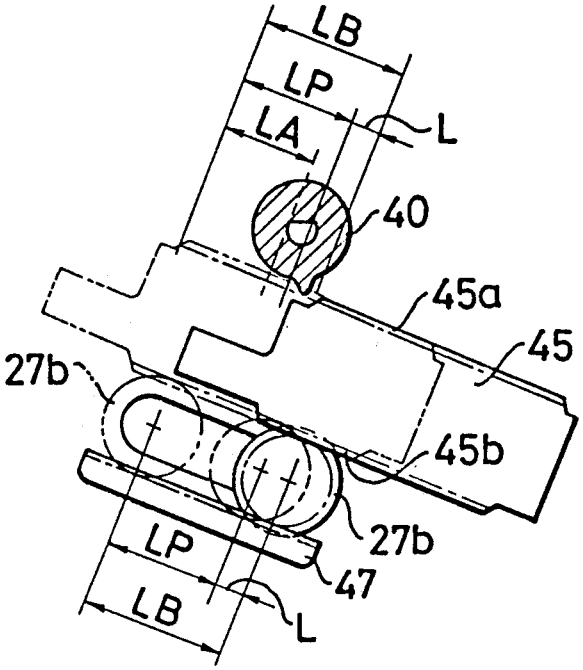
FIG. 22 and FIG. 23 are explanatory views showing the relation between one gear and rack gear in one embodiment of this invention.
Figure 23:
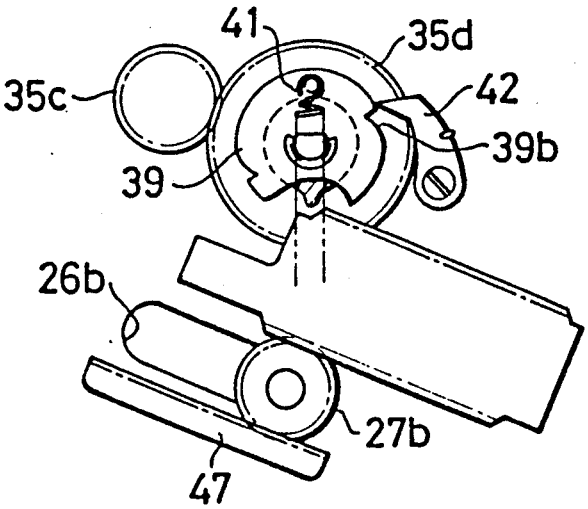

When the volume (thickness) of the sheets 10A sent in the sheet feed stacker 18 is LP or over, the pressure plates 22*a*, 22*b* are advanced forward by the pushing spring 23 and the stacked sheets 10A are pushed against the sheet feed rollers 24*a*, 24*b*, but the starting point of the rack gear 45*a* of the movable rack plate 45 is set in the state separated from the single tooth gear 40 as shown in FIG. 22 and FIG. 23. That is to say, even if the single tooth gear 40 including the ratchet wheel 39 is moved to the position where it engages with the rack gear 45*a* of the movable rack plate 45 by being rotated in the direction of arrow $B_2$ by means of the reversing gear trains 35*a* to 35*d*, the single tooth gear 40 is not engaged with the rack gear 45*a* and rotates without any load. When the single tooth gear 40 runs idle, the pressure plates are not moved backward, applying a great feeding load by the feed rollers 8*a*, 8*b* in the printer; this may result in making the sheet feeding by the feed rollers 8*a*, 8*b* impossible. In this case, the time during which the sheet sensor 49 is ON by the sheets is clocked, and when this clocked time exceeds the predetermined value, alarm may be generated to indicate the occurrence of failure in the backward moving apparatus.

When the alarm sounds, checking the sheet feed stacker 18 can be assured that it has the sheets more than the prescribed volume set therein.

In the above embodiment, the positive rotation of the sheet feed motor 31 rotates the sheet feed rollers 24*a*, 24*b* in the sheet feeding direction to feed the sheets 10A on the pressure plates 22*a*, 22*b* into the printer unit 1. Then, when the leading edge of the sheet 10A is caught to a certain length between the sheet feed rollers 8*a*, 8*b* of the printer unit, the sheet feed motor 31 is rotated reversely to a certain extent to slide the movable rack plate 45 with the single tooth gear 40 and, at the same time, the pinion 27*a* and the pinion 27*b* engaged with the movable rack plate 45 are rolled to move along the stationary racks 47, 48, thereby moving backward the pressure pates 22*a*, 22*b* against the pushing spring 23, and this retracted position is retained with the ratchet wheel 39 and the ratchet 42 attached thereto to separate the stacked sheets from the sheet feed rollers 24*a*, 24*b*, so that the sheet feed unit is released from restricting the sheets. Accordingly, the sheet feeding load on the sheet feed roller in the printer is reduced, and the sheet feeding can be done safely and surely by a contacting pressure of about a degree of a linear contact between the sheet feed rollers 8*a*, 8*b* and 9*a*, 9*b*, and making the contact pressure between the sheet feed rollers to be small can form the sheet feed roller supporting shaft and its supporting mechanism with not so strong materials. Besides, the sheet feed roller drive motor can be made small, so that a printer inexpensive and light can be attained.

The pinions 27*a*, 27*b* disposed at each end of the pressure plate shaft 25 are respectively engaged with the stationary racks 47, 48, and the movable rack plate 45 slidably operated by the single tooth gear 40 is designed to be engaged with the pinion 27*b*, so that the sheet pressing position of the pressure plates is automatically corrected depending on the volume of the stacked sheets. Accordingly, without using a drive source having another structure and regardless of the volume of the stacked sheets in the sheet feed stacker 18, the gap between the sheet feed rollers 24*a*, 24*b* at the time the pressure plates being retracted and the stacked sheets 10A can be kept constant and the moving distance of the stacked sheets is reduced, preventing misalignment of the sheets and buckling possibly caused by the movement.

The single tooth gear 40 and the rack gear 45*a* of the movable rack plate 45 are designed to engage mutually only when they are separated by a range LA which is smaller than the value LP resulting from the deduction of the pressure plate retracted amount L required for the gap G from the maximum retracted amount LB of the pressure plate. Therefore, when the sheets 10A exceeding the applicable volume are accommodated in the sheet feed stacker 18, the single tooth gear 40 rotates idle and the pressure plate does not move backward. Regardless of no room for the retracting distance L to provide the gap G, moving the pressure plates backward allows it to reach the back end on its way moving backward, thereby preventing overheat and loss by burning of the sheet feed motor 31 due to the forced stopping of the single tooth gear 40 while it is rotating, and also it is possible to prevent the single tooth gear 40 and the rack gear 45*c* from engaging abnormally not to cause chamfer or breakage of teeth.

In the above embodiment, the pinions 27*a*, 27*b* fixed to the pressure plate shaft 25 and the rack gears 45*a*, 45*b* engaged therewith are moved forward. As shown in FIG. 17 to FIG. 19, however, the movable rack 45 may be directly attached to the pressure plate shaft 25 integrally.

In this example, the movable rack 45 possesses on its top the rack gear 45*a* which engages with the single tooth gear 40, and on its bottom a surface 45*d* which slides on the thread ridges of the rack gear 45*a*. And, the movable rack 45 is axially supported to be rotatable by the pressure plate shaft 25 and can move back and forth as the pressure plates 22*a*, 22*b* move back and forth. In the drawing, the left side pinion 27*b* is shown. When the pressure plate 22*b* is moved backward by using the left side release lever, the right side pinion 27*a* rotates in synchronous with the rotation of the left side pinion 27*b*, thereby being able to move the both to the same extent.

In the above embodiment, the sheet feeding operation of the sheet feed rollers 24*a*, 24*b* and the retracting operation of the pressure plates 22*a*, 22*b* were described in which the gear train was used for the rotation transmission mechanism. But this is not exclusive and a structure using toothed belt and gears may be used too. Further, the structure for locking the pressure plates 22*a*, 22*b* in the retracted position is not limited to the ratchet wheel and ratchet engaged therewith as in the embodiment. Means to give the movable rack plate with a backward moving force is not limited to the single tooth gear, but a method for attaching to the ratchet wheel a member with a higher coefficient of friction which engages with the movable rack plate may be employed.

Figure 24:
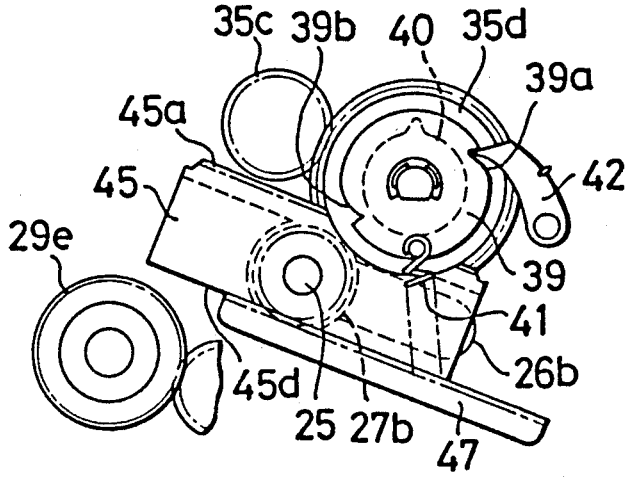
FIG. 24 is a side view showing another embodiment of a rack mechanism in one embodiment of this invention.
Figure 25:
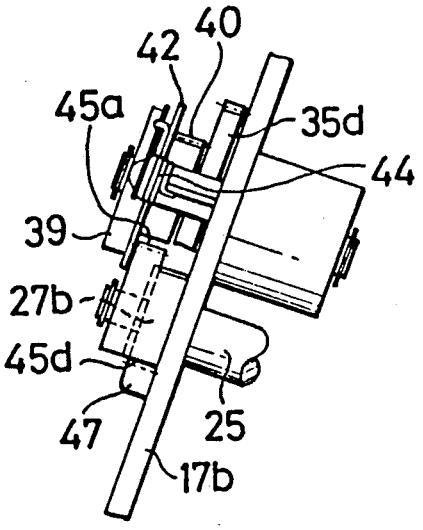
FIG. 25 is a side view of FIG. 24.
Figure 26:
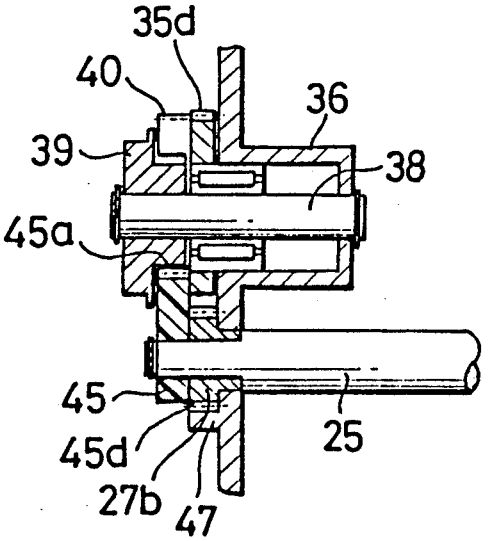
FIG. 26 is a cross-sectional view of FIG. 24.

In the above embodiment, the pinions 27*a*, 27*b* fixed to the pressure plate shaft 25 and the rack gears 45*a*, 45*b* to be engaged therewith were moved forward, but as shown in FIG. 24 to FIG. 26, the movable rack 45 may be directly attached to the pressure plate shaft 25 integrally for example.

In this example, the movable rack 45 possesses on its top the rack gear 45*a* which engages with the single tooth gear 40, and on its bottom a surface 45*d* which slides on the thread ridges of the rack gear 45*a*. And, the movable rack 45 is axially supported to be rotatable by the pressure plate shaft 25 and can move back and forth as the pressure pates 22*a*, 22*b* move back and forth. In the drawing, the left side pinion 27*b* is shown. When the pressure plate 22*b* is moved backward by means of the left side release lever, the right side pinion 27*a* rotates in synchronous with the rotation of the left side pinion 27*b*, thereby being able to move the both to the same extent.

In the above embodiment, the sheet feeding operation of the sheet feed rollers 24*a*, 24*b* and the retracting operation of the pressure plates 22*a*, 22*b* were described in which the gear train was used for the rotation transmission mechanism. But this is not exclusive and a structure using toothed belt and gears may be used too. Further, the structure for locking the pressure plates 22*a*, 22*b* in the retracted position is not limited to the ratchet wheel and ratchet engaged therewith as in the above embodiment. Means to give the movable rack plate with a backward moving force is not limited to the single tooth gear, but a method for attaching to the ratchet wheel a member with a higher coefficient of friction which engages with the movable rack plate may be employed.

Figure 27:
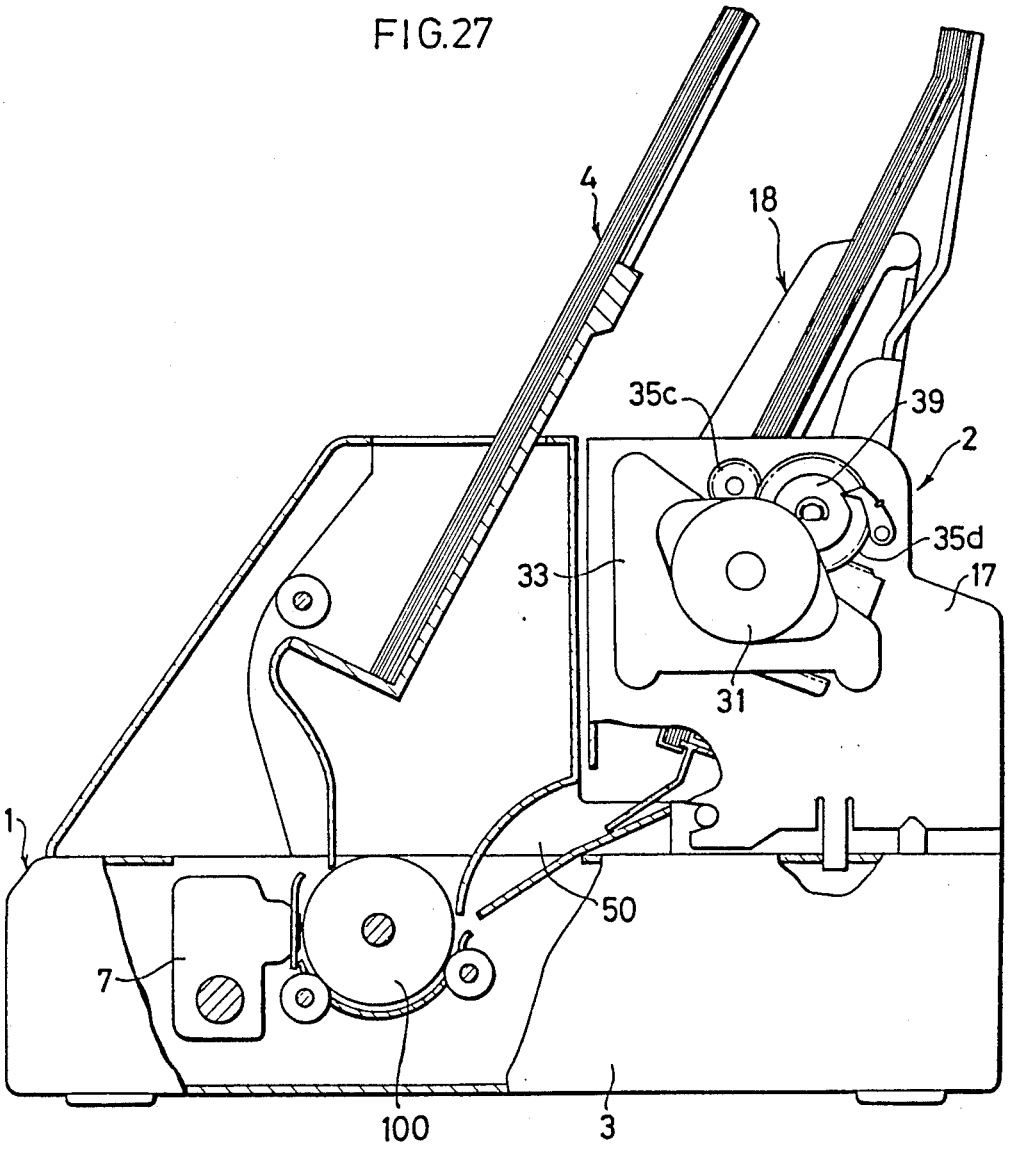
FIG. 27 is a partially broken side view showing another embodiment of the present invention.

In the above embodiments, the description was made on a flat type printer, but for example to the printer which rolls a sheet around one half of the platen disclosed in U.S. Pat. No. 4,687,362, the present invention can be applied. FIG. 27 shows one of such examples, wherein 100 stands for a platen. Other reference numerals are assigned with the same numbers to indicate the same parts as in the previous embodiments.

In this embodiment, to improve printing quality, the platen has its hardness enhanced and the resistance at the stacker could be remedied, the sheet feeding capacity using the platen was lowered though. As a result, the sheets can be fed correctly and the printing quality can be improved as well.

Since it is clear that various embodiments can be structured without separating from the spirit and scope of this invention, the present invention shall not be limited to the specific embodiments excepting for those defined in the attached claims.

What is claimed is:

1. An automatic sheet feed apparatus comprising a pressure plate supported to be movable back and forth by a stacker frame body to push stacked sheets, a sheet feed roller rotatably supported by the frame body, a pushing means to press the stacked sheets against the sheet feed roller through the pressure plate, a sheet feed motor rotatable in either direction mounted on the frame body, a rotation transmission mechanism to transmit the rotation of the positive rotation of the sheet feed motor to the sheet feed roller, an operating mechanism to move the pressure plate back and forth, a rotation transmission mechanism to move backward the pressure plate against the pushing means by transmitting the reverse rotation of the sheet feed motor to the operating mechanism, and a retaining mechanism to hold the pressure plate in the retracted position.

2. An automatic sheet feed apparatus according to claim 1, wherein the operating mechanism works as the pressure plate moves back and forth.

3. An automatic sheet feed apparatus according to claim 1, wherein the retaining mechanism to hold the pressure plate in the backed or advanced position consists of a ratchet and a ratchet wheel.

4. An automatic sheet feed apparatus according to claim 1, wherein the rotation transmission mechanism to operate the mechanism to move backward the pressure plate is a single tooth gear for engaging a rack gear opposed by a movable rack plate, wherein the rotation transmission mechanism has a transmitting distance to the operating mechanism smaller than a distance which is obtained by deducting a distance L from a distance LB, the distance L being a fixed retracted distance that the single tooth gear engaged with the rack gear moves the movable rack plate backward, and the distance LB being the maximum retraction of the pressure plate from a most advanced position.

5. An automatic sheet feed apparatus according to claim 1, wherein the rotation transmission mechanism to move backward the pressure plate is a single tooth gear for engaging a rack mechanism.

* * * * *